United States Patent [19]

Nakazyo et al.

[11] Patent Number: 5,002,861

[45] Date of Patent: Mar. 26, 1991

[54] METHOD FOR PROCESSING A SILVER HALIDE COLOR PHOTOGRAPHIC MATERIAL

[75] Inventors: Kiyoshi Nakazyo; Yoshihiro Fujita, both of Kanagawa, Japan

[73] Assignee: Fuji Photo Film Co. Ltd., Kanagawa, Japan

[21] Appl. No.: 389,666

[22] Filed: Aug. 4, 1989

[30] Foreign Application Priority Data

Aug. 5, 1988 [JP] Japan ..... 63-195771
Jul. 26, 1989 [JP] Japan ..... 1-192887

[51] Int. Cl.[5] ..... G03C 7/00
[52] U.S. Cl. ..... 430/393; 430/393
[58] Field of Search ..... 430/393, 963, 467, 430, 430/461

[56] References Cited

U.S. PATENT DOCUMENTS 4,789,626 12/1988 Sakanoue et al. ..... 430/393
4,801,516 1/1989 Ishikawa et al. ..... 430/380
4,818,664 4/1989 Ueda et al. ..... 430/430
4,818,673 4/1989 Ueda et al. ..... 430/566
4,826,745 5/1989 Groves et al. ..... 430/1
4,830,948 5/1989 Ishikawa et al. ..... 430/372

FOREIGN PATENT DOCUMENTS 0254280 1/1988 European Pat. Off. .
62-222252 9/1987 Japan .

*Primary Examiner*—Paul R. Michl
*Assistant Examiner*—Janis L. Dote
*Attorney, Agent, or Firm*—Sughrue, Mion, Zinn, Macpeak & Seas

[57] ABSTRACT

A method for processing a silver halide color photographic material is disclosed, comprising the step of:

(a) developing an imagewise exposed silver halide color photographic material with a color developing solution comprising not less than $1.9\times10^{-2}$ mol/liter of a color developing agent; and (b) desilvering said developed material with a bleaching solution comprising not less than 0.2 mol/liter of a (1,3-diaminopropanetetraacetato)iron (III) complex salt and having a pH of from 2.5 to 5.5. The method achieves rapid processing without impairing image preservability after processing.

14 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material, and more particularly to a method for rapidly processing a silver halide color photographic material without impairing image storage stability after processing, which includes color development with an improved color developing solution and desilvering with an improved bleaching solution.

BACKGROUND OF THE INVENTION

Processing of color light-sensitive materials generally comprises color development and desilvering as essential steps. In the color development step, silver halide exposed to light is reduced with a color developing agent to produce silver and, at the same time, the oxidized color developing agent is reacted with a color former (coupler) to form a dye image. In the subsequent desilvering step, the silver produced in the color development step is oxidized with an oxidizing agent called a bleaching agent and then dissolved by a silver ion complexing agent commonly called a fixing agent to thereby provide a dye image only on the color light-sensitive material.

The desilvering step includes two-bath desilvering steps which is effected by using a bleaching bath containing a bleaching agent and a fixing bath containing a fixing agent, and monobath desilvering step which is effected by using a bleach-fixing bath containing both the bleaching agent and fixing agent.

Actual development processing of the color light-sensitive materials further includes various auxiliary steps for maintaining photographic and physical qualities of an image or for improving image storage stability, such as hardening, stopping, stabilization, and washing.

With the recent increase of over-the-counter processing service systems used at small-sized laboratories, it has been keenly demanded to reduce the time required for processing so as to rapidly serve of customers. In particular, a reduction in desilvering time that accounts for the majority of the overall processing time has been strongly desired.

Various improvements, such as a combined use of a bleaching accelerator, have been made in the desilvering step. These have not yet been satisfactory, since an (ethylenediaminetetraacetato)iron (III) complex salt, which is a bleaching agent currently used in a bleaching or bleach-fixing solution, has an essential disadvantage of weak oxidizing power.

On the other hand, bleaching agents known to have strong oxidizing power include potassium ferricyanide, bichromates, ferric chloride, persulfates, and bromates. Each of these bleaching agents, however, involves disadvantages from the viewpoint of environmental conservation, safety on handling, and corrosion of metals, so that they are excluded from wide application in over-the-counter processing.

Of the known improvements, a bleaching solution containing a (1,3-diaminopropanetetraacetato)iron (III) complex salt and having a pH of about 6 as described in JP-A-62-222252 (the term "JP-A" as used herein refers to a "published unexamined Japanese patent application") exhibits higher oxidizing power than the bleaching solution containing an (ethylenediaminetetraacetato)iron (III) complex salt, making it feasible to conduct silver bleaching more rapidly. This bleaching solution nevertheless is disadvantageous in that color fog called "bleach fog" results if a light-sensitive material is directly subjected to bleach processing without passing through an intermediate bath after color development.

It is also known in the art (i.e., JP-A-62-222252) that the optimum pH level of a bleaching solution containing an aminopolycarboxylic acid iron (III) complex salt is around 6 from the consideration of a balance between assurance of a bleaching speed and prevention of poor color restoration of a cyan dye. That is, from the fact that a reduction of pH brings about an increase of bleaching speed but, in turn, induces poor color restoration of a cyan dye, a pH of about 6 has been regarded to be the optimum level and thus widely employed in the art.

Rapid processing can also be achieved by reducing the time for color development, e.g., by an increase of pH, an increase of developing temperature, and use of a development accelerator. However, an increase of pH or temperature results in impairment of stability of the processing solution. Further, none of the conventional development accelerators can be applied to practical use without adversely affecting photographic characteristics. Hence, a commonly employed method is increasing the concentration of a developing agent. An increased concentration of a developing agent nevertheless entails a problem of staining after the processing.

SUMMARY OF THE INVENTION

One object of the present invention is to provide a method for processing a silver halide color photographic material, which attains a high color forming property in a reduced developing time.

Another object of the present invention is to provide an improved bleaching bath for desilvering, with which a silver halide color photographic material can be processed in a reduced processing time.

A further object of the present invention is to provide a method for processing a silver halide photographic material, which provides an image having excellent image storage stability, particularly freedom from background stains.

The present inventors have conducted extensive studies with the above-described objects. As a result, it has now been found that, these, and other objects can be accomplished by a method for processing a silver halide photographic material comprising the step of (a) developing an imagewise exposed silver halide color photographic material with a color developing solution comprising not less than $1.9\times10^{-2}$ mol/liter of a color developing agent; and (b) desilvering the developed material with a bleaching solution comprising not less than 0.2 mol/liter of a (1,3-diaminopropanetetraacetato)iron (III) complex salt, and having a pH of from 2.5 to 5.5.

DETAILED DESCRIPTION OF THE INVENTION

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl-N-(β-hydroxyethyl-)amino]aniline
D- 6: 4-Amino-3-methyl-N-ethyl-N-[β-(methanesulfonamino)ethyl]aniline
D- 7: N-(2-Amino-5-diethylaminophenylethyl)methanesulfonamide
D- 8: N,N-Dimethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p-phenylenediamine derivatives, D-5 is particularly preferred.

These p-phenylenediamine derivatives may be in the form of salts such as sulfates, hydrochlorides, sulfites, or p-toluenesulfonates.

The aromatic primary amine developing agent is used in an amount of not less than $1.9\times10^{-2}$ mol/liter of the developing solution.

Speeding up of color development processing can be effectively realized by the use of a sulfate of D-5 as a color developing agent.

If the concentration of the color developing agent is less than $1.9\times10^{-2}$ mol/liter, the developing time becomes longer, failing to achieve speeding up. However, an increased concentration of the developing agent results in an increased uptake of the developing agent in the light-sensitive material, which would adversely affect the stability of the processing solutions used in the succeeding steps. In addition, the residual developing agent adversely affects a dye image during preservation (i.e., storage) or causes stains.

In the present invention, the conventional permissible upper limit of the developing agent concentration can be raised by using the specific bleaching solution hereinafter described. That is, the concentration of the color developing agent which can be used in the present invention is not less than $1.9\times10^{-2}$ mol/ liter, preferably from $1.7\times10^{-2}$ to $1.0\times10^{-1}$ mol/ liter, more preferably from $2.4\times10^{-2}$ to $1.0\times10^{-1}$ mol liter, and most preferably from $3.1\times10^{-2}$ to $6.0\times10^{2}$ mol/liter.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

The color developing solution contains the preservative in an amount of 0.5 g to 10 g and more preferably 1 g to 5 g per liter of the color developing solution.

Further, it is preferred to add, as compounds capable of directly preserving the color developing agent, various hydroxylamines, hydroxamic acids as described in JP-A-63-43138, hydrazines and hydrazides as described in European Patent 254280A, phenols as described in JP-A-63-44657 and JP-A-63-58443, α-hydroxyketones and α-aminoketones as described in JP-A-63-44656, and/or various saccharides as described in JP-A-63-36244 to the color developing solution. Moreover, together with the above-described compounds, monoamines as described in JP-A-63-4235, JP-A-63-24254, JP-A-63-21647, JP-A-63-146040, JP-A-63-27841 and JP-A-63-25654; diamine as described in JP-A-63-30845, JP-A-63-146040 and JP-A-63-43139; polyamines as described in JP-A-63-21647 and JP-A-63-26655; polyamines as described in JP-A-63-44655, nitroxy radicals as described in JP-A-63-53551; alcohols as described in JP-A-63-43140 and JP-A-63-53549; oximes as described in JP-A-63-56654; and tertiary amines as described in European Patent 266,797 are preferably employed.

Other preservatives such as various metals as described in JP-A-57-44148 and JP-A-57-53749, salicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc., may be incorporated into the color developing solution, if desired. Particularly, the addition of aromatic polyhydroxy compounds is preferred.

The color developing solution used in the present invention has a pH which ranges preferably from 9 to 12 and more preferably from 9 to 11.0. The color developing solution may also contain any of the compounds that are known to be usable as components of conventional developing solutions.

In order to maintain the pH within the abovedescribed range, various kinds of buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o- hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter of the developing solution.

In addition, various chelating agents can be used in the color developing solution according to the present invention for the purpose of preventing calcium or magnesium precipitation or increasing the stability of the color developing solution.

As the chelating agents, organic acid compounds are preferred and include aminopolycarboxylic acids, organic phosphoric acids and phosphonocarboxylic acids.

Specific examples of useful chelating agents are set forth below, but the present invention should not be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N'-tetramethylenephosphonic acid
Trans-cyclohexanediaminetetraacetic acid
1,2-Diaminopropanetetraacetic acid
Hydroxyethyliminodiacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

Among these, the aminopolycarboxylic acids are preferred as the chelating agents, and particularly a hydroxyethyliminodiacetic acid is preferred.

The chelating agent is added to the color developing solution in an amount sufficient to block metal ions being present therein. For example, a range of from about 0.1 g to about 10 g per liter of the color developing solution may be employed.

The color developing solution may contain appropriate development accelerators, if desired. However, it is preferred that the color developing solution used in the present invention does not substantially contain benzyl alcohol in view of prevention of environmental pollution, the easy preparation of the solution and prevention of color stain. The term "substantially not contain" means that the color developing solution contains benzyl alcohol in an amount of 2 ml or less per liter of the solution, and preferably does not contain benzyl alcohol at all.

Examples of suitable development accelerators include thioether type compounds as described in JP-B-37-16088, JP-B-37-5987, JP-B-38-7826, JP-B-44-12380, JP-B-45-9019 (the term "JP-B" as used herein refers to an "examined Japanese patent publication" ) and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926; and 3,582,346 and JP-B-41-11431; polyalkylene oxides as described in JP-B-37-16088, JP-B-42-25201, JP-B-41-11431, JP-B-42-23883 and U.S. Pat. Nos. 3,128,183 and 3,532,501; 1-phenyl3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine, etc.

It is preferred that the color developing solution used in the present invention contains a fluorescent brightening agent. As fluorescent brightening agents, 4,4'-diamino-2,2'-disulfostilbene type compounds are preferred. The amount of the fluorescent brightening agent added is from 0 to 5 g and preferably from 0.1 g to 4 g, per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 20° C. to 50° C. and preferably from 30° C. to 45° C. The processing time is usually from 20 seconds to 5 minutes and preferably from 30 seconds to 3 minutes. Further, the amount of replenishment for the color developing solution is preferably as small as feasible, and is usually from 100 ml to 1,500 ml, preferably from 100 ml to 800 ml, and more preferably from 100 ml to 400 ml, per square meter of the color light-sensitive material.

If required, the color developing bath may be divided into two or more baths, so that a color developing replenisher may be supplied from the first bath or the last bath to shorten the developing time or to reduce the amount of the replenisher.

The processing method according to the present invention can be used in a color reversal process. A suitable black-and-white developing solution used in this case includes a black-and-white first developing solution (used in reversal process of color photographic light-sensitive materials), or one that can be used in processing black-and-white photographic light-sensitive materials. Further, known various additives that are generally added to a black-and-white developing solution can be contained in the solution.

Representative additives include developing agents such as 1-phenyl-3-pyrazolidone, Metol ($HOC_6NHCH_3.1/2H_2SO_4$) and hydroquinone; preservatives such as sulfites; accelerators comprising an alkali such as sodium hydroxide, sodium carbonate and potassium carbonate; inorganic or organic restrainers such as potassium bromide, 2-methylbenzimidazole and methylbenzothiazole; hard water softening agents such as polyphosphates; and development restrainers comprising trace amounts (e.g., an amount of generally from $1\times10^{-6}$ to $1\times10^{-4}$ mol/liter and preferably from $5\times10^{-6}$ to $5\times10^{-5}$ mol/liter) of iodides or mercapto compounds.

The bleaching solution to be used in the present invention contains a (1,3-diaminopropanetetraacetato)iron (III) complex salt in an amount of not less than 0.2 mol/liter. Preferred for speeding up processing is a concentration of 0.25 mol/liter or more, and particularly 0.3 mol/liter or more. It should be noted, however, that an excessive concentration of the (1,3-diaminopropanetetraacetato)iron (III) complex salt results in inhibition of bleach. The upper limit is 0.5 mol/liter accordingly. Concentrations of less than 0.2 mol/liter cause not only abrupt retardation of bleach but increased stain after processing. The lower limit of 0.2 mol/liter is therefore an essential condition in the present invention.

The (1,3-diaminopropanetetraacetato)iron (III) complex salt can be used in the form of a salt with ammonium, sodium, potassium, with the ammonium salt being the most preferred for accomplishing rapid bleach.

In the present invention, the pH of the bleaching solution is 5.5 or less, thus surprisingly produce excellent effects while achieving both rapid desilvering and complete color restoration of a cyan dye. The bleaching solution to be used in the present invention has a pH of from 2.5 to 5.5, preferably from 2.5 to 4.5 and more preferably from 2.5 to 4.0. Adjustment of pH to this range can be effected with organic acids, e.g., acetic acid, citric acid, and malonic acid, or inorganic acids, e.g., hydrochloric acid, sulfuric acid, nitric acid, and phosphoric acid. For obtaining a buffer action within the above-recited range, acids having an acid dissociation constant (pKa) ranging from 2.5 to 5.5 are preferred. Such acids include acetic acid, citric acid, and malonic acid as enumerated above, as well as various organic acids, e.g., benzoic acid, formic acid, butyric acid, malic acid, tartaric acid, oxalic acid, propionic acid, and phthalic acid. Particularly preferred of them is acetic acid.

The acid is preferably used in an amount of generally from 0.1 to 2 mols and more preferably from 0.5 to 1.5 mols, per liter of the bleaching solution.

It is desirable to use 1,3-diaminopropanetetraacetic acid in a slight excess over the theoretical amount necessary to form a complex with an iron (III) ion, preferably in a 1 to 10 mol% excess.

The bleaching solution may further contain other aminopolycarboxylic acid iron (III) complex salts than the (1,3-diaminopropanetetraacetato)iron (III) complex salt in combination. For example, iron (III) complex salts of ethylenediaminetetraacetic acid, diethylenetriaminepentaacetic acid and cyclohexanediaminetetraacetic acid can be employed.

The bleaching solution can contain various bleaching accelerators. Examples of useful bleaching accelerators are compounds having a mercapto or disulfide group as described in U.S. Pat. No. 3,893,858, West German Patent 1,290,812, British Patent 1,138,842, JP-A-53-95630, and Research Disclosure, No. 17129 (July, 1978); thiazolidine derivatives as described in JP-A-50-140129; thiourea derivatives as described in U.S. Pat. 3,706,561; iodides as described in JP-A-58-16235; polyethylene oxides as described in West German Patent 2,748,430; and polyamine compounds as described in JP-B-45-8836. Preferred among them are mercapto compounds as described in British Patent 1,138,842. An amount of the bleaching accelerators used in the present invention is generally from $1\times10^{-4}$ to $2\times10^{-2}$ mol/ liter and preferably from $2\times10^{-4}$ to $1\times10^{-2}$ mol/liter based on the bleaching solution.

In addition to the above-described bleaching agents and other additives, the bleaching solution can further contain rehalogenating agents including bromides (e.g., potassium bromide, sodium bromide, ammonium bromide) and chlorides (e.g., potassium chloride, sodium chloride, and ammonium chloride). The rehalogenating agent is usually used in a concentration of from 0.1 to 5 mols and preferably from 0.5 to 3 mols, per liter of the bleaching solution.

It is also advantageous to use ammonium nitrate as a metal corrosion inhibitor in the bleaching solution. An amount of the metal corrosion inhibitor used in the present invention is generally from 0.1 to 1.5 mol/liter and preferably from 0.2 to 1.2 mol/liter based on the bleaching solution.

The bleaching bath of the present invention is usually replenished at a rate of from 50 to 2,000 ml and preferably from 100 to 1,000 ml, per $m^2$ of the light-sensitive material.

In carrying out the processing, it is preferable to subject the bleaching solution to aeration to oxidize the (1,3-diaminopropanetetraacetato)iron (II) complex salt produced by the processing.

After or simultaneously with the bleach processing, the light-sensitive material is subjected to fixing. Fixing agents which can be used include thiosulfates, e.g., sodium thiosulfate, ammonium thiosulfate, sodium ammonium thiosulfate, and potassium thiosulfate; thiocyanates, e.g., sodium thiocyanate, ammonium thiocyanate, and potassium thiocyanate; thiourea; and thioethers, with ammonium thiosulfate being preferred. The amount of the fixing agent to be used is from 0.3 to 3 mols and preferably from 0.5 to 2 mols, per liter of the fixing solution.

From the standpoint of fixing acceleration, it is also preferable to use ammonium thiocyanate, thiourea or a thioether (e.g., 3,6-dithia-1,8-octanediol) in combination with ammonium thiosulfate. These compounds are usually used in an amount of from about 0.01 to 0.1 mol per liter of the fixing solution. In some cases, use of from 1 to 3 mols/liter greatly improves fixing acceleration.

The fixing solution can contain preservatives, such as sulfites (e.g., sodium sulfite, potassium sulfite, ammonium sulfite), hydroxylamine, hydrazine, and bisulfite adductive compounds of aldehyde compounds (e.g., sodium aldehyde bisulfite). It can further contain brightening agents, defoaming agents, surface active agents, polyvinylpyrrolidone, and organic solvents (e.g., methanol). It is particularly preferable to use a sulfinic acid compound as disclosed in JP-A-62-143048 as a preservative.

The rate of replenishment of the fixing solution preferably ranges from 300 to 3,000 ml and more preferably from 300 to 1,000 ml, per $m^2$ of the light-sensitive material.

Further, the fixing solution preferably contains various aminopolycarboxylic acids or organic phosphonic acids for the purpose of stabilization.

The fixing solution may be a bleach-fixing solution having a combined bleaching and fixing function.

The benefits of the present invention become more pronounced as the total time of desilvering becomes shorter. A preferred desilvering time is from 1 to 4 minutes and more preferably from 1 minute and 30 seconds to 3 minutes. The processing temperature is generally from 25° C. to 50° C. and preferably from 35° C to 45° C. The desilvering being carried out within the preferred temperature range, the rate of desilvering increases, and stain formation after the processing can be effectively prevented.

For assuring the benefits of the present invention, it is favorable that the desilvering be carried out under enhanced stirring to a high degree as possible. Enhanced stirring can be exercised by a method of striking a jet stream of a processing solution against the emulsion surface of the light-sensitive material as described in JP-A-62-183460 and JP-A-62-183461, a method using a rotating means to heighten the stirring effect as described in JP-A-62-183461, a method in which the light-sensitive material is moved with its emulsion surface being in contact with a wire blade placed in a processing solution so that a turbulent flow is produced on the emulsion surface to improve the stirring effect, and a method of increasing the total circulatory flow of a processing solution. These means for enhanced stirring are effectively applicable to any of the bleaching solution, bleach-fixing solution, and fixing solution. Enhanced stirring is believed to accelerate the supply of the bleaching agent or fixing agent to the emulsion surface, thereby increasing the rate of desilvering.

The above-described means for enhanced stirring is especially effective in case of using a bleaching accelerator. In this case, the acceleration effect can be markedly heightened or the unfavorable effect of the bleaching accelerator on inhibition of fixing can be eliminated.

An automatic developing machine which can be used in the present invention preferably has a means for carrying the light-sensitive material as disclosed in JP-A-60-191257, JP-A-60-191258 and JP-A-60-191259. As illustrated in JP-A-60-191257, such a carrier means considerably reduces carry-over of a processing solution into the succeeding bath to effectively prevent deterioration of the processing solution. This is especially advantageous for reduction of processing time in each step or reduction of replenishment rate.

The present invention produces remarkable advantages when the overall processing time (i.e., all the processing time from which only the drying time is excluded) is short. More specifically, appreciable effects are obtained when the overall processing time is within 8 minutes, and a marked difference from the conventional processing methods is produced when the overall processing time is within 7 minutes. Accordingly, the processing of the present invention is preferably carried out within 8 minutes and more preferably within minutes.

The processing method according to the present invention comprises processing steps including color development, bleaching, bleach-fixing, fixing, etc., as mentioned above. After the bleach-fixing or fixing step, although processing steps that include water washing and stabilizing are generally carried out, a simple processing method is also possible wherein after being processed in a bath having a fixing ability, a stabilizing process is carried out without performing substantial water washing.

The washing water used in the water washing step can contain, if desired, known additives. For example, hard water softening agents such as inorganic phosphoric acid, aminopolycarboxylic acids and organic phosphoric acids, antibacterial and antifungal agents for preventing various bacteria and algae from proliferating (e.g., isothiazolone, organic chlorine type disinfectants and benzotriazole) and surface active agents for lowering drying load or for preventing uneven drying can be used. Compounds described, for example, in L.E. West, "Water Quality Criteria", *Phot. Sci. and Eng.*, Vol. 9, No. 6, pages 344 to 359 (1965) can also be used.

A suitable stabilizing solution used in the stabilizing step includes a processing solution for stabilizing dye images. For example, a solution having a pH of from 3 to 6 and a buffering ability and a solution containing an aldehyde (e.g., formalin) can be used. The stabilizing solution can contain, if desired, ammonium compounds, compounds containing metals such as Bi and Al, fluorescent brightening agents, chelating agents (e.g., 1-hydroxyethylidene-1,1-diphosphonic acid), antibacterial, antifungal agents, hardening agents, surface active agents, etc.

It is preferred to employ a multistage counter-current system in the water washing step or stabilizing step. Two to four stages are preferably used. The amount of replenishment is from 1 to 50 times, preferably from 2 to 30 times and more preferably from 2 to 15 times the amount of processing solution carried over from the preceding bath per a unit area of the color light-sensitive material.

Water suitable for use in the water washing step or the stabilizing step includes city (tap) water, water that has been deionized, for example, by ion exchange resins to reduce Ca and Mg concentrations to 5 mg/liter or below, or water that has been sterilized, for example, by a halogen lamp or a bactericidal ultraviolet lamp.

When continuous processing is performed using an automatic developing machine, concentration of the processing solution tends to occur by evaporation in each step of the processing of color light-sensitive materials. This phenomenon particularly occurs in a case wherein a small amount of color light-sensitive materials is processed or wherein an open area of the processing solution is large. In order to compensate for such concentration of processing solution, it is preferred to replenish them with an appropriate amount of water or a correcting solution.

A technique of introducing an overflow from the water washing or stabilizing step into the prebath of the bath having fixing ability serves to reduce the amount of waste liquor.

The light-sensitive materials to be processed according to the present invention may be those which comprise a support having provided thereon at least one of blue-sensitive silver halide emulsion layer, green-sensitive silver halide emulsion layer and red-sensitive silver halide emulsion layer, and are not particularly limited as to the number and the order of silver halide emulsion layers and light-insensitive layers. A typical silver halide photographic material comprises a support having provided thereon at least one light-sensitive layer composed of plural silver halide emulsion layers having substantially the same color sensitivity but having different sensitivities, said light-sensitive layer being a unit light-sensitive layer having color sensitivity to any of blue light, green light and red light. In multilayered silver halide color photographic materials, the unit light-sensitive layers are provided in the order of red-sensitive layer, green-sensitive layer and blue-sensitive layer from the support side. However, reverse order may be employed depending upon intended purpose, or an order wherein a layer having different light sensitivity is sandwiched between layers having the same color sensitivity may be employed.

Various light-insensitive layers such as interlayers sensitive layers or as an uppermost or lowermost layer.

The interlayer may contain couplers, DIR compounds, etc., as described in JP-A-61-43748, JP-A-59-113438, JP-A-59-113440, JP-A-61-20037 and JP-A-61-20038, and color mixing preventing agents used commonly Plural silver halide emulsion layers constituting each unit light-sensitive layer preferably have a two-layer structure of high speed emulsion layer and slow speed emulsion layer as described in West German Patent 1,121,470 or British Patent 923,045. Usually, they are disposed in such order that the sensitivity decreases towards the support. A light-insensitive layer may be provided between the silver halide emulsion layers. In addition, the slow speed emulsion layer may be provided at a position further the support, and the high speed emulsion layer may be provided at a position nearer the support as described in JP-A-57-112751, JP-A-62-200350, JP-A-62-206541 and JP-A-62-206543.

As specific examples, the layers may be provided in the order, from the further side of the support, a slow speed blue-sensitive layer (BL)/a high speed blue-sensitive layer (BH)/a high speed green-sensitive layer (GH)/a slow speed green-sensitive layer (GL)/a high speed red-sensitive layer (RH)/a slow speed red-sensitive layer (RL), or in the order of BH/BL/GL/GH/RH/RL or in the order of BH/BL/GH/GL/RL/RH.

As described in JP-B-55-34932, it is also possible to provide in the order of blue-sensitive layer/GH/RH/GL/RL from the furthest side of the support. In addition, as is described in JP-A-56-25738 and JP-A-6263936, an order of blue-sensitive layer/GL/RL/GH/RH from the furthest side of the support may be employed.

As is described in JP-B-49-15495, an order wherein three layers having different sensitivities are arranged in such order that sensitivity is decreased towards the support, i.e., an order of a silver halide emulsion layer having the highest sensitivity (top layer), a silver halide emulsion layer having a middle sensitivity (middle layer), and a silver halide emulsion layer having the lowest sensitivity (bottom layer) may also be employed. In this case, too, the three layers with the same color sensitivity may be disposed in the order of a medium speed emulsion layer having middle sensitivity/a high speed emulsion layer having the highest sensitivity/a slow speed emulsion layer having the lowest sensitivity as described in JP-A-59-202464.

As is described above, various layer structures and orders of the layers may be selected according to the purpose of each of light-sensitive materials.

Silver halide preferably incorporated in the photographic emulsion layers of the photographic light-sensitive material of the present invention is silver bromoiodide, silver chloroiodide or silver chlorobromoiodide having a silver iodide content of about 30 mol% or less. Particularly preferable silver halide is silver bromoiodide or silver chlorobromoiodide having a silver iodide content of from about 2 mol% to about 25 mol%.

Silver halide grains in the photographic emulsion may have a regular crystal form such as cubic, octahedral or tetradecahedral form, an irregular form such as spherical or plate form, a form with crystal defect such as twin plane, or a composite form thereof.

With respect to the grain size of silver halide grains, both fine grains of not larger than about 0.2 μm and large sized grains of up to about 10 μm in projected area diameter may be used. The emulsion may be a polydispersed emulsion or a monodispersed emulsion.

The silver halide photographic emulsion to be used in the present invention may be prepared according to processes described in, for example, *Research Disclosure (RD),* No. 17643 (December, 1978), pp. 22 and 23, "I. Emulsion Preparation and Types" and ibid , No. 18716 (November, 1979), p. 648, P. Glafkides, *Chimie et Physique Photographique,* Paul Montel (1967), G.F. Duffin, *Photographic Emulsion Chemistry,* Focal Press (1966), V.L. Zelikman et al., *Making and Coating Photographic Emulsion,* Focal Press (1964), etc.

Monodispersed emulsions described in U.S. Pat. Nos. 3,574,628 and 3,655,394 and British Patent 1,413,748 are also preferred.

Tabular grains having an aspect ratio of from about 5 or more can also be used in the present invention. Such tabular grains may be easily prepared according to processes described in Gutoff, *Photographic Science and Engineering,* Vol. 14, pp. 248 to 257 (1970), U.S. Pat. Nos. 4,434,226, 4,414,310, 4,433,048, 4,439,520 and British Patent 2,112,157.

Crystal structure may be a uniform structure, a structure wherein the inner portion and the outer portion are different from each other in halide composition, or a layered structure, or silver halide crystals different from each other may be conjugated to each other by epitaxial conjunction or, further, crystals conjugated to other compounds than silver halide such as silver rhodanine or lead oxide may be used. In addition, a mixture of grains of various crystal forms may also be used.

The silver halide emulsions to be used in the present invention are usually subjected to physical ripening, chemical ripening, and spectral sensitization before use. Additives to be used in these steps are described in *Research Disclosure,* Nos. 17643 and 18716. Places where such additives are described are shown in the table to be shown hereinafter.

Known photographic additives to be used in the present invention are also described in the abovedescribed two Research Disclosure numbers, and places where they are described are also shown in the following table.

| Additives | RD 17643 | RD 18716 |
|---|---|---|
| 1. Chemical Sensitizers | Page 23 | Page 648, right column |
| 2. Sensitivity Increasing Agents | — | " |
| 3. Spectral Sensitizing Agents and Supersensitizing Agents | Pages 23–24 | Page 648, right column to page 649, right column |
| 4. Brightening Agents | Page 24 | — |
| Antifoggants and Stabilizers | Pages 24–25 | Page 649, right column |
| 6. Light Absorbents, Filter Dyes, and UV Ray Absorbents | Pages 25–26 | Page 649, right column to page 650, left column |
| 7. Antistaining Agents | Page 25, right column | Page 650, left to right columns |
| 8. Dye Image Stabilizers | Page 25 | — |
| 9. Hardeners | Page 26 | Page 651, left column |
| 10. Binders | Page 26 | " |
| 11. Plasticizers and Lubricants | Page 27 | Page 650, right column |
| 12. Coating Aids and Surfactants | Pages 26–27 | " |
| 13. Antistatic Agents | Page 27 | " |

Further, in order to prevent the deterioration of photographic properties, compounds which can be reacted and fixed with the formaldehydes as described in U.S. Pat. Nos. 4,411,987 and 4,435,503 are preferably added to the light-sensitive material of the present invention.

Various color couplers may be used in the present invention, and specific examples thereof are described in the patents described in the foregoing *Research Disclosure (RD),* No. 17643, VII-C to G.

As yellow couplers, those described in, for example, U.S. Pat. Nos. 3,933,501, 4,022,620, 4,326,024, 4,401,752, 4,248,961, 3,973,968, 4,314,023 and 4,511,649, JP-B-58-10739. British Patents 1,425,020 and 1,476,760, European Patent 249,473A, etc., are described.

As magenta couplers, 5-pyrazolone type and pyrazoloazole type compounds are preferred, with those described in U.S. Pat. Nos. 4,310,619, 4,351,897, European Patent 73,636, U.S. Pat. Nos. 3,061,432, 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, U.S. Pat. Nos. 4,500,630, 4,556,630 and 4,540,654, WO (PCT) 88/04795, etc., being particularly preferable.

As cyan couplers, there are illustrated phenolic and naphtholic couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German (OLS) 3,329,729, European Patents 121,365A and 249,453A, U.S. Pat. Nos. 3,446,622, 4,333,999, 4,753,871, 4,451,559, 4,427,767, 4,690,889, 4,254,212, 4,296,199, JP-A-61-42658, etc., are preferred.

As colored couplers for correcting unnecessary absorption of colored dyes, those which are described in *Research Disclosure,* No. 17643, Item VII-G, U.S. Pat. No. 4,163,670, JP-B-57-39413, U.S. Pat. Nos. 4,004.,929 and 4,138,258, British Patent 1,146,368, etc., are preferable.

As couplers capable of forming colored dyes with a suitable diffusibility, those which are described in U.S. Pat. No. 4,366,237, British Patent 2,125,570, European Patent 96,570, and West German Patent (OLS) 3,234,533 are preferred.

Typical examples of polymerized dye-forming couplers are described in U.S. Pat. Nos. 3,451,820, 4,080,211, 4,367,282, 4,409,320, 4,576,910 and British Patent 2,102,173.

Couplers capable of releasing a photographically useful residue upon coupling reaction are also preferably used in the present invention. As DIR couplers capable of releasing a development inhibitor, those which are described in patents described in the foregoing RD, No. 17643, Item VII-F, JP-A-57-151944, JP-A-57-154234, JP-A-60-184248, JP-A-63-37346, and U.S. Pat. No. 4,248,962 are preferred.

As couplers capable of imagewise releasing a nucleating agent or a development accelerator upon development, those which are described in British Patents 2,097,140 and 2,131,188, JP-A-59-157638 and JP-A-59-170840 are preferred.

As further couplers to be used in the light-sensitive material of the present invention, there are illustrated competitive couplers described in U.S. Pat. No. 4,130,427, etc., poly-equivalent couplers described in U.S. Pat. Nos. 4,283,472, 4,338,393, 4,310,618, etc., DIR redox compound-releasing couplers, DIR coupler-releasing couplers, DIR coupler-releasing redox compounds or DIR redox-releasing redox compounds described in JP-A-60-185950 and JP-A-62-24252, couplers capable of being subjected to color restoration after being released described in European Patent 173,302A, bleaching accelerator-releasing couplers described in RD, Nos. 11449 and 24241, JP-A-61-201247, liquid-releasing couplers described in U.S. Pat. No. 4,553,477, leuco pigment-releasing couplers described in JP-A-63-75747, and the like.

The couplers to be used in the present invention may be introduced into light-sensitive materials by various known dispersing methods.

Examples of high boiling organic solvents to be used in an oil-in-water dispersion method are described, e.g., in U.S. Pat. No. 2,322,027.

Specific examples of the high boiling organic solvent having a boiling point of 175° C or higher at normal pressure which can be used in the water-in-oil dispersion process include phthalic ester (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate), benzoic esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl tosylate), aniline derivatives (e.g., N,N-dibutyl-2-butoxy-5-t-octylaniline), and hydrocarbons (e.g., paraffin, dodecylbenzene, diisopropylnaphthalene). The high boiling organic solvents may be used in combination with auxiliary solvents, such as organic solvents having a boiling point of about 30° C. or more and preferably of from 50° C. to about 160° C. (e.g., ethyl acetate, butyl acetate, ethyl propionate, methyl ethyl ketone, cyclohexanone, 2-ethoxyethyl acetate, dimethylformamide).

Details of a latex dispersion method, its effects, and impregnating latexes suitable for use therein are disclosed, e.g., in U.S. Pat. No. 4,199,363, and West German Patents (OLS) 2,541,274 and 2,541,230.

The present invention is applicable to various types of color light-sensitive materials, typically including color negative films for general use or for movies, color reversal films for slides or TV, color papers, color positive films, and color reversal papers.

Supports which can be used in the present invention are described, e.g., in *Research Disclosure*, No. 17643, p. 28, ibid., 18716, p. 647, right column to p. 648, left column.

In the light-sensitive materials of the present invention, hydrophilic colloidal layers on the emulsion layer side preferably have a total film thickness of not more than 28 μm and a rate of swelling ) of not more than 30 seconds. The terminology "film thickness" as used herein means the thickness as measured after conditioning at 25° C. and 55% RH for 2 days. The terminology "rate of swelling" as used herein means the time required for the film thickness to reach half the saturated film thickness, the saturated film thickness being defined as 90% of the maximum swollen film thickness reached when a light-sensitive material is processed in a color developing solution at 30° C. for 3 minutes and 15 seconds. The rate of swelling $T_{\frac{1}{2}}$ can be measured according to technique known in the art. For example, it can be measured with a swelling meter of the type described in A. Green et al., *Phot. Sci. Eng.*, Vol. 19, No. 2, pp. 124 to 129.

The rate of swelling $T_{\frac{1}{2}}$ can be controlled by addition of a hardening agent to gelatin to be used as a binder or by alteration of conditions after coating. The degree of swelling preferably ranges from 150 to 400%. The terminology "degree of swelling" as used herein means the percentage of an increase of thickness (maximum swollen film thickness - initial film thickness) to initial film thickness.

The present invention is now illustrated in greater detail with reference to the following Examples, but the present invention is not to be construed as being limited thereto. Unless otherwise indicated, all parts, percents and ratios are by weight.

Regarding the amount of the respective components as coated, the silver halide and colloidal silver are represented by the units of $g/m^2$ as silver coated; the coupler, additives and gelatin are represented by the units of $g/m^2$; and the sensitizing dye is represented by the number of mols per mol of the silver halide in the same layer.

EXAMPLE 1

Abbreviations used in the compositions shown have the following meanings:

| | |
|---|---|
| UV: | Ultraviolet absorbent |
| Solv: | High boiling organic solvent |
| ExF: | Dye |
| ExS: | Sensitizing dye |
| ExC: | Cyan coupler |
| ExM: | Magenta coupler |
| ExY: | Yellow coupler |

-continued

Cpd: Additive
H: Hardening agent

A triacetyl cellulose film support having a subbing layer was coated with the following layers in the order listed to prepare a multilayer color light-sensitive material (Sample 01).

| | |
|---|---|
| 1st Layer: Antihalation Layer: | |
| Black Colloidal Silver | 0.2 g/m$^2$ |
| Gelatin | 1.3 g/m$^2$ |
| ExM-8 | 0.06 g/m$^2$ |
| UV-1 | 0.1 g/m$^2$ |
| UV-2 | 0.2 g/m$^2$ |
| Solv-1 | 0.01 g/m$^2$ |
| Solv-2 | 0.01 g/m$^2$ |
| 2nd Layer: Interlayer: | |
| Fine Silver Bromide Grains (mean grain size: 0.07 μm) | 0.10 g of Ag/m$^2$ |
| Gelatin | 1.5 g/m$^2$ |
| UV-1 | 0.06 g/m$^2$ |
| UV-2 | 0.03 g/m$^2$ |
| ExC-2 | 0.02 g/m$^2$ |
| ExF-1 | 0.004 g/m$^2$ |
| Solv-1 | 0.1 g/m$^2$ |
| Solv-2 | 0.09 g/m$^2$ |
| 3rd Layer: 1st Red-Sensitive Emulsion Layer: | |
| Silver Iodobromide Emulsion (AgI: 2 mol %; high internal AgI type; sphere equivalent diameter: 0.3 μm; coefficient of variation of sphere equivalent diameter: 29%; regular twin mixed crystal grains; diameter/thickness ratio: 2.5) | 0.4 g of Ag/m$^2$ |
| Gelatin | 0.6 g/m$^2$ |
| ExS-1 | $1.0 \times 10^{-4}$ mol/mol of AgX |
| ExS-2 | $3.0 \times 10^{-4}$ mol/mol of AgX |
| ExS-3 | $1 \times 10^{-5}$ mol/mol of AgX |
| ExC-3 | 0.06 g/m$^2$ |
| ExC-4 | 0.06 g/m$^2$ |
| ExC-7 | 0.04 g/m$^2$ |
| ExC-2 | 0.03 g/m$^2$ |
| Solv-1 | 0.03 g/m$^2$ |
| Solv-3 | 0.012 g/m$^2$ |
| 4th Layer: 2nd Red-Sensitive Emulsion Layer: | |
| Silver Iodobromide Emulsion (AgI: 5 mol %; high internal AgI type; sphere equivalent diameter: 0.7 μm; coefficient of variation of sphere equivalent diameter: 25%; regular twin mixed crystal grains; diameter/thickness ratio: 4) | 0.7 g of Ag/m$^2$ |
| Gelatin | 0.5 g/m$^2$ |
| ExS-1 | $1 \times 10^{-4}$ mol/mol of AgX |
| ExS-2 | $3 \times 10^{-4}$ mol/mol of AgX |
| ExS-3 | $1 \times 10^{-5}$ mol/mol of AgX |
| ExC-3 | 0.24 g/m$^2$ |
| ExC-4 | 0.24 g/m$^2$ |
| ExC-7 | 0.04 g/m$^2$ |
| ExC-2 | 0.04 g/m$^2$ |
| Solv-1 | 0.15 g/m$^2$ |
| Solv-3 | 0.02 g/m$^2$ |
| 5th Layer: 3rd Red-Sensitive Emulsion Layer: | |
| Silver Iodobromide Emulsion (AgI: 10 mol %; high internal AgI type; sphere equivalent diameter: 0.8 μm; coefficient of variation of sphere equivalent diameter: 16%; regular twin mixed crystal grains; diameter/thickness ratio: 1.3) | 1.0 g of Ag/m$^2$ |
| Gelatin | 1.0 g/m$^2$ |
| ExS-1 | $1 \times 10^{-4}$ mol/mol of AgX |
| ExS-2 | $3 \times 10^{-4}$ mol/mol of AgX |
| ExS-3 | $1 \times 10^{-5}$ mol/mol of AgX |
| ExC-5 | 0.05 g/m$^2$ |
| ExC-6 | 0.1 g/m$^2$ |
| Solv-1 | 0.01 g/m$^2$ |
| Solv-2 | 0.05 g/m$^2$ |
| 6th Layer: Interlayer: | |
| Gelatin | 1.0 g/m$^2$ |
| Cpd-1 | 0.03 g/m$^2$ |
| Solv-1 | 0.05 g/m$^2$ |

-continued

| | |
|---|---|
| 7th Layer: 1st Green-Sensitive Emulsion Layer: | |
| Silver Iodobromide Emulsion (AgI: 2 mol %; high internal AgI type; sphere equivalent diameter: 0.3 μm; coefficient of variation of sphere equivalent diameter: 28%; regular twin mixed crystal grains; diameter/thickness ratio: 2.5) | 0.30 g of Ag/m$^2$ |
| ExS-4 | $5 \times 10^{-4}$ mol/mol of AgX |
| ExS-6 | $0.3 \times 10^{-4}$ mol/mol of AgX |
| ExS-5 | $2 \times 10^{-4}$ mol/mol of AgX |
| Gelatin | 1.0 g/m$^2$ |
| ExM-9 | 0.2 g/m$^2$ |
| ExY-14 | 0.03 g/m$^2$ |
| ExM-8 | 0.03 g/m$^2$ |
| Solv-1 | 0.5 g/m$^2$ |
| 8th Layer: 2nd Green-Sensitive Emulsion Layer: | |
| Silver Iodobromide Emulsion AgI: 4 mol %; high internal AgI type; sphere equivalent diameter: 0.6 μm; coefficient of variation of sphere equivalent diameter: 38%; regular twin mixed crystal grains; diameter/thickness ratio: 4) | 0.4 g of Ag/m$^2$ |
| Gelatin | 0.5 g/m$^2$ |
| ExS-4 | $5 \times 10^{-4}$ mol/mol of AgX |
| ExS-5 | $2 \times 10^{-4}$ mol/mol of AgX |
| ExS-6 | $0.3 \times 10^{-4}$ mol/mol of AgX |
| ExM-9 | 0.25 g/m$^2$ |
| ExM-8 | 0.03 g/m$^2$ |
| ExM-10 | 0.015 g/m$^2$ |
| ExY-14 | 0.01 g/m$^2$ |
| Solv-1 | 0.2 g/m$^2$ |
| 9th Layer: 3rd Green-Sensitive Emulsion Layer: | |
| Silver Iodobromide Emulsion (AgI: 6 mol %; high internal AgI type; sphere equivalent diameter: 1.0 μm; coefficient of variation of sphere equivalent diameter: 80%; regular twin mixed crystal grains; diameter/thickness ratio: 1.2) | 0.85 g of Ag/m$^2$ |
| Gelatin | 1.0 g/m$^2$ |
| ExS-7 | $3.5 \times 10^{-4}$ mol/mol of AgX |
| ExS-8 | $1.4 \times 10^{-4}$ mol/mol of AgX |
| ExM-11 | 0.01 g/m$^2$ |
| ExM-12 | 0.03 g/m$^2$ |
| ExM-13 | 0.20 g/m$^2$ |
| ExM-8 | 0.02 g/m$^2$ |
| ExY-15 | 0.02 g/m$^2$ |
| Solv-1 | 0.20 g/m$^2$ |
| Solv-2 | 0.05 g/m$^2$ |
| 10th Layer: Yellow Filter Layer: | |
| Gelatin | 1.2 g/m$^2$ |
| Yellow Colloidal Silver | 0.08 g/m$^2$ |
| Cpd-2 | 0.1 g/m$^2$ |
| Solv-1 | 0.3 g/m$^2$ |
| 11th Layer: 1st Blue-Sensitive Emulsion Layer: | |
| Silver Iodobromide Emulsion (AgI: 4 mol %; high internal AgI type; sphere equivalent diameter: 0.5 μm; coefficient of variation of sphere equivalent diameter: 15%; octahedral grains) | 0.4 g of Ag/m$^2$ |
| Gelatin | 1.0 g/m$^2$ |
| ExS-9 | $2 \times 10^{-4}$ mol/mol of AgX |
| ExY-16 | 0.9 g/m$^2$ |
| ExY-14 | 0.07 g/m$^2$ |
| Solv-1 | 0.2 g/m$^2$ |
| 12th Layer: 2nd Blue-Sensitive Emulsion Layer: | |
| Silver Iodobromide Emulsion (AgI: 10 mol %; high internal AgI type; sphere equivalent diameter: 1.3 μm; coefficient of variation of sphere equivalent diameter: regular twin mixed crystal grains; diameter/thickness ratio: 4.5) | 0.5 g of Ag/m$^2$ |
| Gelatin | 0.6 g/m$^2$ |
| ExS-9 | $1 \times 10^{-4}$ mol/mol of AgX |
| ExY-16 | 0.25 g/m$^2$ |
| Solv-1 | 0.07 g/m$^2$ |
| 13th Layer: 1st Protective Layer: | |
| Gelatin | 0.8 g/m$^2$ |

-continued

| | |
|---|---|
| UV-1 | 0.1 g/m$^2$ |
| UV-2 | 0.2 g/m$^2$ |
| Solv-1 | 0.01 g/m$^2$ |
| Solv-2 | 0.01 g/m$^2$ |
| 14th Layer: 2nd Protective Layer: | |
| Fine Silver Bromide Grains (mean grain size: 0.07 μm) | 0.5 g of Ag/m$^2$ |
| Gelatin | 0.45 g/m$^2$ |
| Polymethyl Methacrylate Particles (diameter: 1.5 μm) | 0.2 g/m$^2$ |
| H-1 | 0.4 g/m$^2$ |
| Cpd-3 | 0.5 g/m$^2$ |
| Cpd-4 | 0.5 g/m$^2$ |

Each of the above layers additionally contains a surface active agent as a coating aid.

The compounds used in the sample preparation are shown below:

UV-1

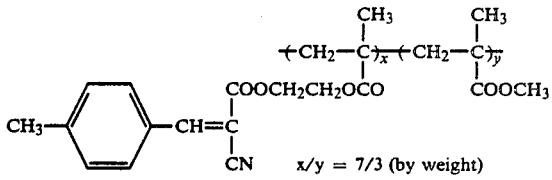

UV-2

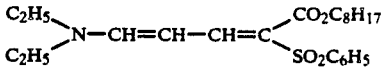

| | |
|---|---|
| Tricresyl Phosphate | Solv-1 |
| Dibutyl Phthalate | Solv-2 |
| Bis(2-ethylhexyl) Phthalate | Solv-3 |

ExM-8

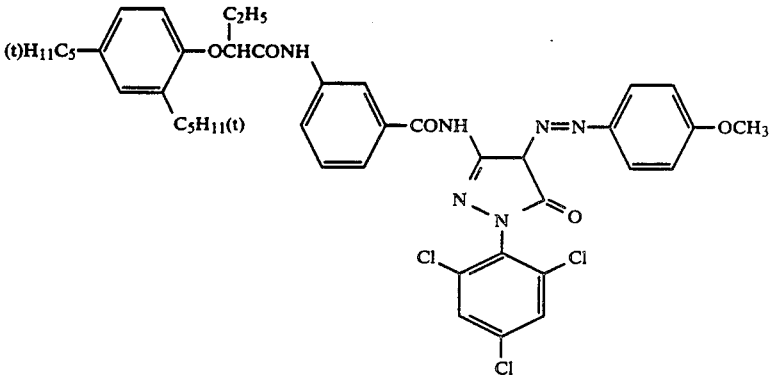

ExF-1

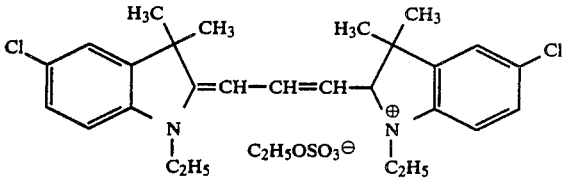

ExC-2

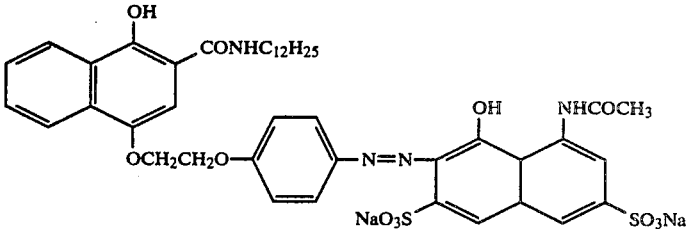

-continued
ExC-3
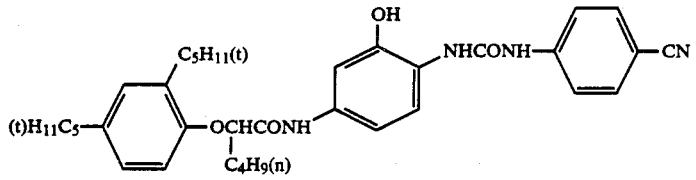
ExC-4
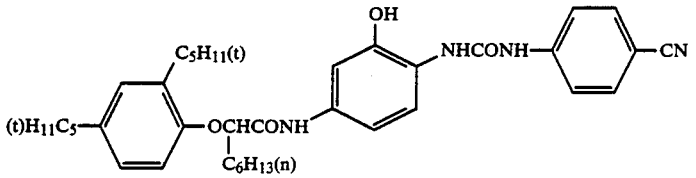
ExY-14
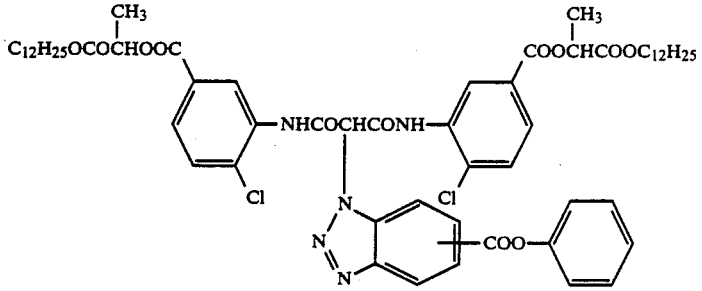
ExY-15
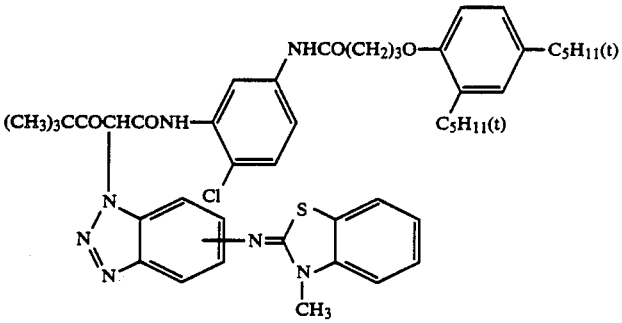
ExC-5
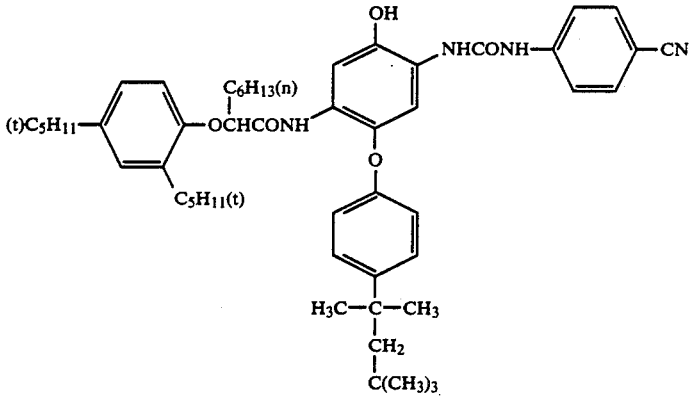
ExC-6
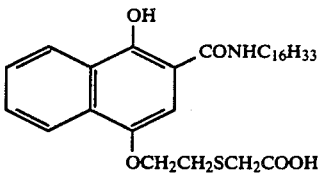

-continued
ExC-7
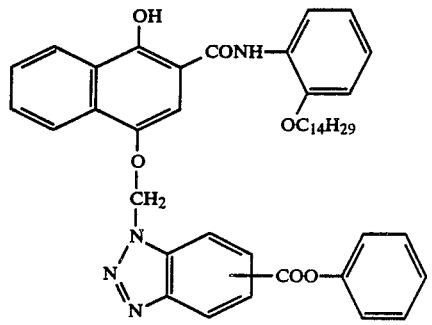
ExM-9
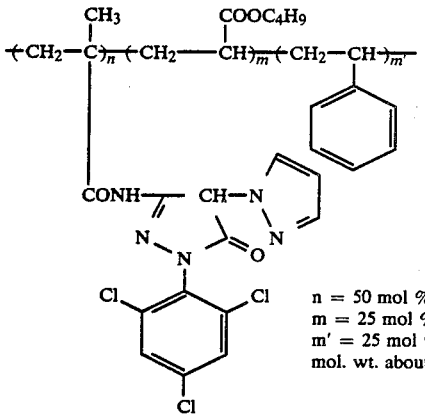
n = 50 mol %
m = 25 mol %
m' = 25 mol %
mol. wt. about 20,000
ExM-10
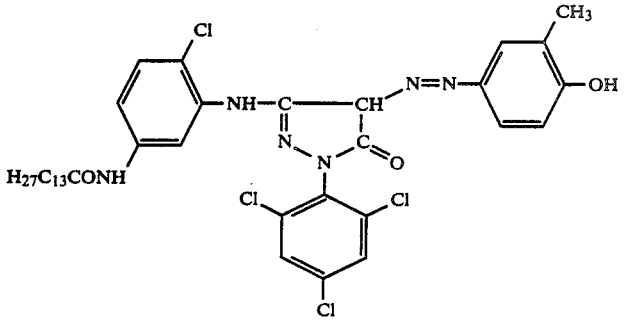
ExM-11
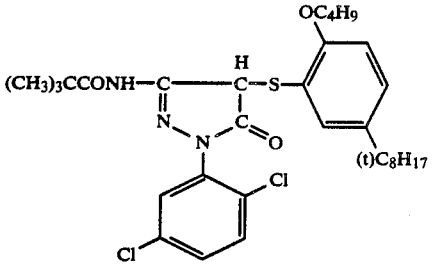

-continued
ExM-13
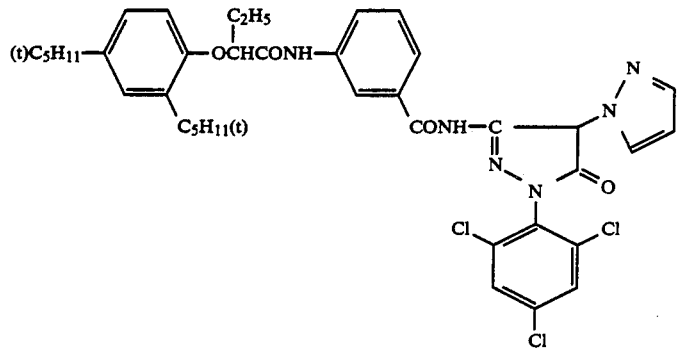
ExY-16
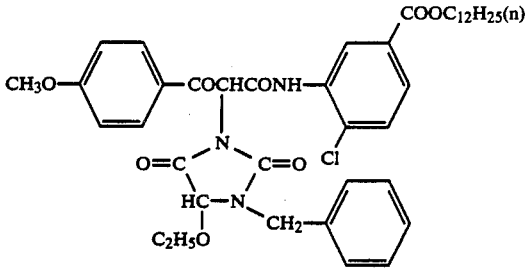
Cpd-1
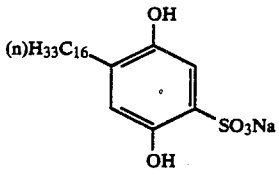
Cpd-2
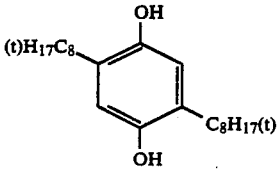
ExS-1
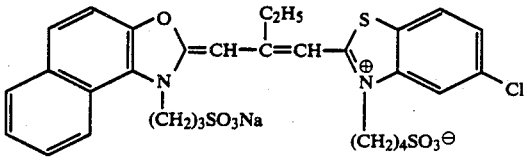
ExS-2
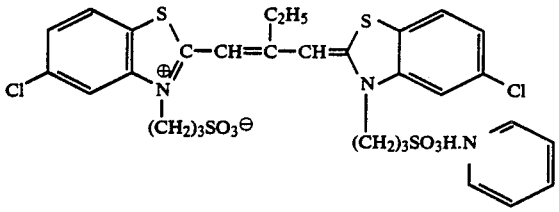
ExS-3
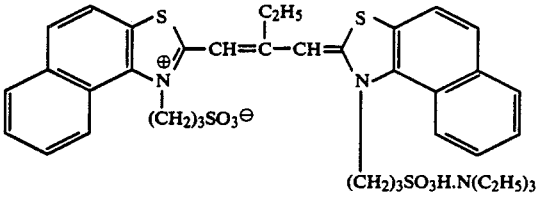

-continued
ExS-4
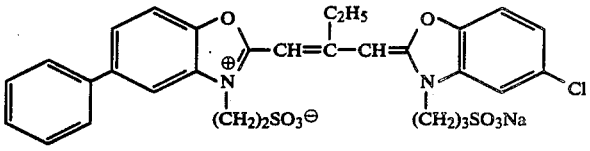
ExS-5
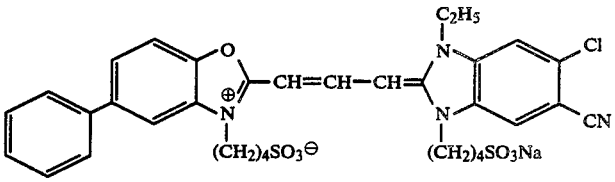
ExS-6
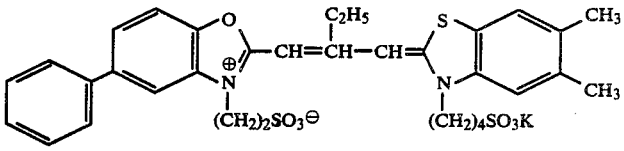
ExS-7
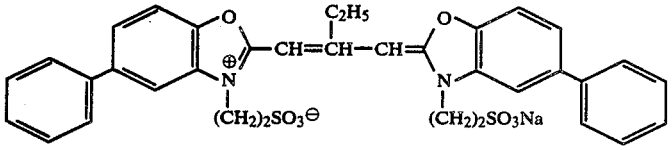
ExS-8
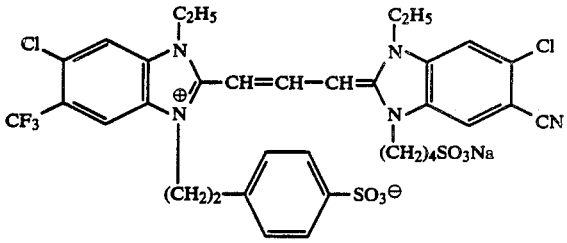
ExS-9
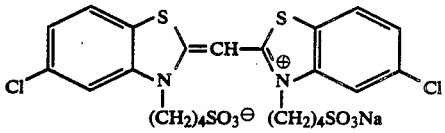
H-1
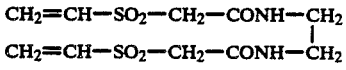
Cpd-3
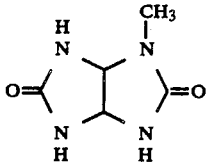
Cpd-4
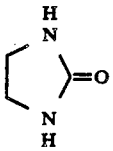
The above obtained Sample 01 was exposed to light using a light source having a color temperature of 4,800° K., at 20 luxes for 0.1 second and processed by means of an automatic developing machine using processing solutions having the following compositions.

| | | |
|---|---|---|
| Color Development | 38.0 | 3 min 15 sec |
| Bleaching | 38.0 | 6 min |
| Fixing (1) | 38.0 | 45 sec |
| Fixing (2) | 38.0 | 45 sec |
| Washing (1) | 38.0 | 15 sec |
| Washing (2) | 38.0 | 15 sec |
| Stabilization | 38.0 | 15 sec |
| Drying | 60.0 | 45 sec |

The fixing step was carried out with the jet stirring device illustrated in JP-A-183460 (page 3) so that the light-sensitive material was processed while being struck by a jet stream of the fixing solution.

| | |
|---|---|
| Color Developing Solution: | |
| Hydroxyethyliminodiacetic Acid | 5.0 g |
| Sodium Sulfite | 4.0 g |
| Potassium Carbonate | 30.0 g |
| Potassium Bromide | 1.3 g |
| Potassium Iodide | 1.2 mg |
| Hydroxylamine Sulfate | 2.0 g |
| 4-(N-Ethyl-N-β-hydroxyethylamino)-2-methylaniline Sulfate (color developing agent) | $1.6 \times 10^{-2}$ mol |
| 1-Hydroxyethylidene-1,1-diphosphonic Acid | 3.0 g |
| Water to make | 1.0 liter |
| pH | 10.05 |
| Bleaching Solution: | |
| (Ethylenediaminetetraacetato) Iron (III) Complex Salt (EDTA.Fe) | 0.3 mol |
| 1,3-Diaminopropanetetraacetic Acid | 3.0 g |
| Ammonium Bromide | 100 g |
| Acetic Acid | 50 g |
| Ammonium Nitrate | 30 g |
| Water to make | 1.0 liter |
| Acetic Acid and Ammonia to adjust to a pH of | 6.0 |
| Fixing Solution: | |
| 1-Hydroxyethylidene-1,1-diphosphonic Acid | 7.0 g |
| Disodium Ethylenediaminetetraacetate | 7.0 g |
| Ammonium Sulfite | 16.0 g |
| Ammonium Thiosulfate Aqueous Solution (700 g/liter) | 240 ml |
| 3,6-Dithia-1,8-octanediol | 5.0 g |
| Water to make | 1.0 liter |
| Acetic Acid and Ammonia to adjust to a pH of | 6.5 |

Washing Water:

Tap water was passed through a mixed bed column filled with an H-type strongly acidic cation exchange resin "Amberlite IR-120B" (produced by Rohm & Haas) and an OH-type anion exchange resin "Amberlite IRA-400" (produced by Rohm & Haas) to thereby decrease calcium and magnesium ions to 3 mg/liter or less, respectively, and to the treated water were then added 20 mg/liter of sodium dichloroisocyanurate and 0.15 g/liter of sodium sulfate. The thus prepared liquid had a pH between 6.5 and 7.5.

| | |
|---|---|
| Stabilizing Solution: | |
| Formalin (37 wt %) | 2.0 ml |
| Polyoxyethylene-p-monononylphenyl Ether (average degree of polymerization: 10) | 0.3 g |
| Disodium Ethylenediaminetetraacetate | 0.05 g |
| Water to make | 1.0 liter |
| pH | 5.0 to 8.0 |

After the above processing was completed, the density of each sample was measured by the method as described below to evaluate the suitable developing time and the occurrence of stain after storage.

Suitable Developing Time (see Table 1-a)

The density of each processed sample was measured using a Macbeth densitometer. The obtained magenta density was 1.5. Each of samples was processed by varying the concentration of color developing agent in the color developing solution as shown in Table 1-a, and further by varying the color developing time. Then, the developing time necessary for obtaining the magenta density of 1.5 was measured at various concentrations of the color developing solution.

The results are shown in Table 1-a.

Stain after Storage (See Table 1-a)

At various developing times as shown in Table 1-a, the concentration of EDTA.Fe and pH in the bleaching solution described above were changed to the concentration of EDTA.Fe and DPTA.Fe and pH as shown in Table 1-a, and the bleaching time was set to 45 seconds. Then, each of unexposed samples, Sample 01, was processed with the bleaching solution.

Immediately after each of samples was processed, the magenta density of each sample was measured, and further after each of the samples was stored under the conditions of 60° C. and 70% RH for 30 days, the magenta density of each sample was measured again.

The term "stain after storage" means the obtained increase of density due to storage.

The results are shown in Table 1-a.

TABLE 1-a

| Bleaching Solution | | | Stain after Storage*** Amount of Color Developing Agent ($\times 10^{-2}$ mol/liter) | | | | | | | | |
|---|---|---|---|---|---|---|---|---|---|---|---|
| Amount of DPTA Fe (mol/l) | Amount of EDTA Fe (mol/l) | pH | 1.0 | 1.2 | 1.9 | 2.4 | 3.1 | 4.1 | 6.0 | 7.0 | |
| — | 0.3 | 6.3 | 0.12 | 0.18 | 0.26 | 0.35 | 0.37 | 0.39 | 0.40 | 0.41 | |
| — | 0.3 | 3.5 | 0.12 | 0.18 | 0.27 | 0.31 | 0.34 | 0.36 | 0.37 | 0.38 | |
| 0.15 | 0.15 | 6.0 | 0.12 | 0.18 | 0.29 | 0.32 | 0.34 | 0.37 | 0.38 | 0.38 | |
| 0.15 | 0.15 | 3.5 | 0.12 | 0.18 | 0.24 | 0.25 | 0.27 | 0.29 | 0.32 | 0.33 | |
| 0.20 | 0.1 | 6.0 | 0.12 | 0.18 | 0.27 | 0.29 | 0.31 | 0.33 | 0.34 | 0.36 | |
| 0.20 | 0.1 | 3.5 | 0.12 | 0.12 | 0.11 | 0.11 | 0.11 | 0.11 | 0.11 | 0.11 | * |
| 0.25 | 0.05 | 6.0 | 0.12 | 0.18 | 0.24 | 0.25 | 0.26 | 0.27 | 0.27 | 0.30 | |
| 0.25 | 0.05 | 3.5 | 0.12 | 0.12 | 0.10 | 0.10 | 0.09 | 0.09 | 0.09 | 0.10 | * |
| 0.30 | — | 6.0 | 0.12 | 0.16 | 0.18 | 0.20 | 0.22 | 0.23 | 0.25 | 0.26 | |
| 0.30 | — | 5.5 | 0.12 | 0.11 | 0.09 | 0.09 | 0.07 | 0.07 | 0.07 | 0.09 | * |
| 0.30 | — | 4.3 | 0.12 | 0.11 | 0.07 | 0.06 | 0.05 | 0.05 | 0.05 | 0.07 | |
| 0.30 | — | 3.5 | 0.12 | 0.11 | 0.06 | 0.06 | 0.04 | 0.04 | 0.04 | 0.06 | |
| 0.30 | — | 2.5 | 0.12 | 0.11 | 0.06 | 0.06 | 0.04 | 0.04 | 0.04 | 0.06 | |
| 0.30 | — | 2.0 | 0,12 | 0.14 | 0.15 | 0.15 | 0.15 | 0.15 | 0.15 | 0.15 | |
| ** | | | 4 min | 3 min | 2 min | 2 min | 2 min | 1 min | 1 min | 1 min | |

TABLE 1-a-continued

| Bleaching Solution | | | Stain after Storage*** Amount of Color Developing Agent (× $10^{-2}$ mol/liter) | | | | | | | |
|---|---|---|---|---|---|---|---|---|---|---|
| Amount of DPTA Fe (mol/l) | Amount of EDTA Fe (mol/l) | pH | 1.0 | 1.2 | 1.9 | 2.4 | 3.1 | 4.1 | 6.0 | 7.0 |
| | | | | 30 sec | 30 sec | 15 sec | | 45 sec | 30 sec | 15 sec |

* [ ] is the present invention
**Suitable developing time
***It is preferred that the value of the stain after storage is smaller.

As is apparent from the results of Table 1-a, the developing time is shortened by increase of the concentration of the color developing agent. However, when the EDTA.Fe which has been conventionally used is used as a bleaching agent or a small amount (0.15 mol/ liter) of DPTA.Fe is used, the stain after storage is deteriorated by increase of the concentration of the color developing agent, which is not suitable for practical use.

While, when the DPTA.Fe concentration and the pH are within the present invention, the stain after storage is effectively inhibited, and the stability of image is not deteriorated even if the rapid processing is carried out.

EXAMPLE 2

Sample 01 prepared in Example 1 was cut to a width of 35 mm and was exposed under the condition with a sensitivity of ISO 100 in a camera. The obtained samples were continuously processed at the rate of 30 m per day for 15 days using the following processing step and composition.

| Processing Step | Processing Temperature (°C.) | Time | Replenisher Amount (ml/35 mm (w) × 1 m) | Tank Capacity (l) |
|---|---|---|---|---|
| Color Development | 40.0 | 2 min 15 sec | 15 | 4 |
| Bleaching | 38.0 | 45 sec | 4.5 | 2 |
| Fixing (1) | 38.0 | 45 sec | (two-tank countercurrent system) | 2 |
| Fixing (2) | 38.0 | 45 sec | 15 | 2 |
| Washing (1) | 38.0 | 15 sec | (two-tank countercurrent system) | 1 |
| Washing (2) | 38.0 | 15 sec | 15 | 1 |
| Stabilization | 38.0 | 15 sec | 15 | 1 |
| Drying | 60.0 | 45 sec | | |

The fixing tank of the automatic developing machine used was equipped with the jet stirring device illustrated in JP-62-183460 (page 3) so that the light-sensitive material was processed while being struck by a jet stream of the fixing solution.

| | Mother liquor | Replenisher |
|---|---|---|
| Color Developing Solution (CD-11): | | |
| Hydroxyethyliminodiacetic Acid | 5.0 g | 7.0 g |
| Sodium Sulfite | 4.0 g | 6.0 g |
| Potassium Carbonate | 30.0 g | 35.0 g |
| Potassium Bromide | 1.3 g | 0.2 g |
| Potassium Iodide | 1.2 mg | — |
| Hydroxylamine Sulfate | 2.0 g | 4.0 g |
| 4-(N-Ethyl-N-β-hydroxyethylamino)-2-methylaniline Sulfate (color developing agent) | 2.4 × $10^{-2}$ mol | 3.0 × $10^{-2}$ mol |
| 1-Hydroxyethylidene-1,1-diphosphonic Acid | 3.0 g | 4.0 g |

-continued

| | Mother liquor | Replenisher |
|---|---|---|
| Water to make | 1.0 liter | 1.0 liter |
| pH | 10.05 | 10.20 |
| Bleaching Solution: | | |
| (1,3-Diaminopropanetetraacetato) Iron (III) Complex Salt (DPTA.Fe) | 120 g | 180 g |
| 1,3-Diaminopropanetetraacetic Acid | 3.0 g | 5.0 g |
| Ammonium Bromide | 100 g | 150 g |
| Acetic Acid | 50 g | 80 g |
| Ammonium Nitrate | 30 g | 40 g |
| Water to make | 1.0 liter | 1.0 liter |
| Acetic Acid and Ammonia to adjust to a pH of | 4.0 | 3.3 |
| Fixing Solution: | | |
| 1-Hydroxyethylidene-1,1-diphosphonic Acid | 7.0 g | 10.0 g |
| Disodium Ethylenediaminetetraacetate | 7.0 g | 10.0 g |
| Ammonium Sulfite | 16.0 g | 25.0 g |
| Ammonium Thiosulfate Aqueous Solution (700 g/liter) | 240 ml | 280 ml |
| 3,6-Dithia-1,8-octanediol | 5.0 g | 7.0 g |
| Water to make | 1.0 liter | 1.0 liter |
| Acetic Acid and Ammonia to adjust to a pH of | 6.5 | 6.5 |

Washing Water (stability solution):

The mother liquor and replenisher each was common, and was the same as the washing water and stabilizer solution in Example 1.

The pH of the bleaching solution which was obtained by the above method was adjusted using ammonia water or acetic acid as shown in Table 2.

Sample 01 was exposed to light using a light source having a color temperature of 4,800° K. at 200 luxes for 0.1 second. The exposed sample was processed with the same manner as in Example 1 at each pH, except that the bleaching time was changed to 20, 35, 45, or 60 seconds for each bleaching solution.

EXAMPLE 3

After the processing, the sample was analyzed by X-ray fluorometric analysis method to determine silver remaining therein. The results obtained are shown in Table 2.

TABLE 2

| Bleaching Solution | pH of Bleaching Solution | Residual Ag ($\mu g/cm^2$) Bleaching Time (sec) 20 | 35 | 45 | 60 | Remarks |
|---|---|---|---|---|---|---|
| BL-1 | 6.0 | 25.8 | 14.3 | 13.2 | 12.4 | Comparison |
| BL-2 | 5.5 | 4.3 | 3.0 | 2.0 | 1.0 | Invention |
| BL-3 | 4.8 | 3.6 | 2.5 | 1.8 | 0.9 | " |
| BL-4 | 4.3 | 3.4 | 2.4 | 1.7 | 0.8 | " |
| BL-5 | 3.5 | 3.0 | 2.0 | 1.6 | 0.8 | " |
| BL-6 | 2.0 | 12.3 | 6.2 | 3.3 | 3.0 | Comparison |

It is clearly seen from the results of Table 2, that even if the bleaching time is shortened, a sufficient bleaching can be achieved according to the present invention.

The same procedures as in Examples 1 and 2 were carried out except that the following Samples 02 and 03 were used in place of Sample 01. As a result, the same results as in Examples 1 and 2 were obtained.

Sample 02 (a color light-sensitive material)

Regarding the amount of the respective components as coated, the silver halide and colloidal silver are represented by the units of $g/m^2$ as silver coated; the coupler, additives and gelatin are represented by the units of $g/m^2$; and the sensitizing dye is represented by the number of mols per mol of the silver halide in the same layer.

A multilayer color light-sensitive material (Sample 02) having an undercoated triacetyl cellulose film support having provided thereon the layers shown below was prepared.

Abbreviations used in the compositions shown have the following meanings:

| | |
|---|---|
| 1st Layer: Antihalation Layer: | |
| Black Colloidal Silver | 0.15 $g/m^2$ |
| Gelatin | 2.9 $g/m^2$ |
| UV-1 | 0.03 $g/m^2$ |
| UV-2 | 0.06 $g/m^2$ |
| UV-3 | 0.07 $g/m^2$ |
| Solv-2 | 0.08 $g/m^2$ |
| ExF-1 | 0.01 $g/m^2$ |
| ExF-2 | 0.01 $g/m^2$ |
| 2nd Layer: Slow Speed Red-Sensitive Emulsion Layer: | |
| Silver Iodobromide Emulsion (AgI: 4 mol %; uniform AgI type; sphere equivalent diameter: 0.4 $\mu m$; coefficient of variation of sphere equivalent diameter: 37%; tabular grain; diameter/thickness ratio: 3.0) | 0.4 g of $Ag/m^2$ |
| Gelatin | 0.8 $g/m^2$ |
| ExS-1 | $2.3 \times 10^{-4}$ mol/mol of AgX (X: halogen) |
| ExS-2 | $1.4 \times 10^{-4}$ mol/mol of AgX |
| ExS-5 | $2.3 \times 10^{-4}$ mol/mol of AgX |
| ExS-7 | $8.0 \times 10^{-6}$ mol/mol of AgX |
| ExC-1 | 0.17 $g/m^2$ |
| ExC-2 | 0.03 $g/m^2$ |
| ExC-3 | 0.13 $g/m^2$ |
| 3rd Layer: Medium Speed Red-Sensitive Emulsion Layer: | |
| Silver Iodobromide Emulsion (AgI: 6 mol %; high internal AgI type at a core/shell ratio of 2/1; sphere equivalent diameter: 0.65 $\mu m$; coefficient of variation of sphere equivalent diameter: 25%; tabular grains; diameter/thickness ratio: 2.0) | 0.65 g of $Ag/m^2$ |
| Silver Iodobromide Emulsion (AgI: 4 mol %; uniform AgI type; sphere equivalent diameter: 0.4 $\mu m$; coefficient of variation of sphere equivalent diameter: 37%; tabular grains; diameter/thickness ratio: 3.0) | 0.1 g of $Ag/m^2$ |
| Gelatin | 1.0 $g/m^2$ |
| ExS-1 | $2 \times 10^{-4}$ mol/mol of AgX |
| ExS-2 | $1.2 \times 10^{-4}$ mol/mol of AgX |
| ExS-5 | $2 \times 10^{-4}$ mol/mol of AgX |
| ExS-7 | $7 \times 10^{-6}$ mol/mol of AgX |
| ExC-1 | 0.31 $g/m^2$ |
| ExC-2 | 0.01 $g/m^2$ |
| ExC-3 | 0.06 $g/m^2$ |
| 4th Layer: High Speed Red-Sensitive Emulsion Layer: | |
| Silver Iodobromide Emulsion (AgI: 6 mol %; high internal AgI type at a core/shell ratio of 2/1; sphere equivalent diameter: 0.7 $\mu m$; coefficient of variation of sphere equivalent diameter: 25%; tabular grains; diameter/thickness ratio: 2.5) | 0.9 g of $Ag/m^2$ |
| Gelatin | 0.8 $g/m^2$ |
| ExS-1 | $1.6 \times 10^{-4}$ mol/mol of AgX |
| ExS-2 | $1.6 \times 10^{-4}$ mol/mol of AgX |
| ExS-5 | $1.6 \times 10^{-4}$ mol/mol of AgX |

-continued

| | |
|---|---|
| ExS-7 | $6 \times 10^{-4}$ mol/mol of AgX |
| ExC-1 | 0.07 g/m$^2$ |
| ExC-4 | 0.05 g/m$^2$ |
| Solv-1 | 0.07 g/m$^2$ |
| Solv-2 | 0.20 g/m$^2$ |
| Cpd-7 | $4.6 \times 10^{-4}$ g/m$^2$ |
| 5th Layer: Interlayer: | |
| Gelatin | 0.6 g/m$^2$ |
| UV-4 | 0.03 g/m$^2$ |
| UV-5 | 0.04 g/m$^2$ |
| Cpd-1 | 0.1 g/m$^2$ |
| Polyethyl Acrylate Latex | 0.08 g/m$^2$ |
| Solv-1 | 0.05 g/m$^2$ |
| 6th Layer: Slow Speed Green-Sensitive Emulsion Layer: | |
| Silver Iodobromide Emulsion (AgI: 4 mol %; uniform AgI type; sphere equivalent diameter: 0.4 μm; coefficient of variation of sphere equivalent diameter: 37%, tabular grains; diameter/thickness ratio: 2.0) | 0.18 g of Ag/m$^2$ |
| Gelatin | 0.4 g/m$^2$ |
| ExS-3 | $2 \times 10^{-4}$ mol/mol of AgX |
| ExS-4 | $7 \times 10^{-4}$ mol/mol of AgX |
| ExS-5 | $1 \times 10^{-4}$ mol/mol of AgX |
| ExM-5 | 0.11 g/m$^2$ |
| ExM-7 | 0.03 g/m$^2$ |
| ExY-8 | 0.01 g/m$^2$ |
| Solv-1 | 0.09 g/m$^2$ |
| Solv-4 | 0.01 g/m$^2$ |
| 7th Layer: Medium Speed Green-Sensitive Emulsion Layer: | |
| Silver Iodobromide Emulsion (AgI: 4 mol %; high surface AgI type at a core/shell ratio of 1/1; sphere equivalent diameter: 0.5 μm; coefficient of variation of sphere equivalent diameter: 20%; tabular grains; diameter/thickness ratio: 4.0) | 0.27 g of Ag/m$^2$ |
| Gelatin | 0.6 g/m$^2$ |
| ExS-3 | $2 \times 10^{-4}$ mol/mol of AgX |
| ExS-4 | $7 \times 10^{-4}$ mol/mol of AgX |
| ExS-5 | $1 \times 10^{-4}$ mol/mol of AgX |
| ExM-5 | 0.17 g/m$^2$ |
| ExM-7 | 0.04 g/m$^2$ |
| ExY-8 | 0.02 g/m$^2$ |
| Solv-1 | 0.14 g/m$^2$ |
| Solv-4 | 0.02 g/m$^2$ |
| 8th Layer: High Speed Green-Sensitive Emulsion Layer: | |
| Silver Iodobromide Emulsion (AgI: 8.7 mol %; multilayer structure having an Ag ratio of 3/4/2; AgI content: 24 mol %, 0 mol %, and 3 mol % from the inside; sphere equivalent diameter: 0.7 μm; coefficient of variation of sphere equivalent diameter: 25%; tabular grains; diameter/thickness ratio: 1.6) | 0.7 g of Ag/m$^2$ |
| Gelatin | 0.8 g/m$^2$ |
| ExS-4 | $5.2 \times 10^{-4}$ mol/mol of AgX |
| ExS-5 | $1 \times 10^{-4}$ mol/mol of AgX |
| ExS-8 | $0.3 \times 10^{-4}$ mol/mol of AgX |
| ExM-5 | 0.1 g/m$^2$ |
| ExM-6 | 0.03 g/m$^2$ |
| ExY-8 | 0.02 g/m$^2$ |
| ExC-1 | 0.02 g/m$^2$ |
| ExC-4 | 0.01 g/m$^2$ |
| Solv-1 | 0.25 g/m$^2$ |
| Solv-2 | 0.06 g/m$^2$ |
| Solv-4 | 0.01 g/m$^2$ |
| Cpd-7 | $1 \times 10^{-4}$ g/m$^2$ |
| 9th Layer: Interlayer: | |
| Gelatin | 0.6 g/m$^2$ |
| Cpd-1 | 0.04 g/m$^2$ |
| Polyethyl Acrylate Latex | 0.12 g/m$^2$ |
| Solv-1 | 0.02 g/m$^2$ |
| 10th Layer: Layer Providing Interlayer Effect to Red-Sensitive Emulsion Layer: | |
| Silver Iodobromide Emulsion (AgI: high internal AgI type at a core/shell ratio of 2/1; sphere equivalent diameter: 0.7 μm; coefficient of variation of sphere equivalent diameter: 25%; tabular grains; diameter/thickness ratio: 2.0) | 0.68 g of Ag/m$^2$ |

-continued

| | |
|---|---|
| Silver Iodobromide Emulsion (AgI: 4 mol %; uniform AgI type; sphere equivalent diameter: 0.4 μm; coefficient of variation of sphere equivalent diameter: 37%; tabular grains; diameter/thickness ratio: 3.0) | 0.19 g of Ag/m$^2$ |
| Gelatin | 1.0 g/m$^2$ |
| ExS-3 | 6 × 10$^{-4}$ mol/mol of AgX |
| ExM-10 | 0.19 g/m$^2$ |
| Solv-1 | 0.20 g/m$^2$ |
| 11th Layer: Yellow Filter Layer: | |
| Yellow Colloidal Silver | 0.06 g/m$^2$ |
| Gelatin | 0.8 g/m$^2$ |
| Cpd-2 | 0.1 g/m$^2$ |
| Solv-1 | 0.13 g/m$^2$ |
| Cpd-1 | 0.07 g/m$^2$ |
| Cpd-6 | 0.002 g/m$^2$ |
| H-1 | 0.13 g/m$^2$ |
| 12th Layer: Slow Speed Blue-Sensitive Emulsion Layer: | |
| Silver Iodobromide Emulsion (AgI: 4.5 mol %; uniform AgI type; sphere equivalent diameter: 0.7 μm; coefficient of variation of sphere equivalent diameter: 15%; tabular grains; diameter/thickness ratio: 7.0) | 0.3 g of Ag/m$^2$ |
| Silver Iodobromide Emulsion (AgI: 3 mol %; uniform AgI type; sphere equivalent diameter: 0.3 μm; coefficient of variation of sphere equivalent diameter: 30%; tabular grains; diameter/thickness ratio: 7.0) | 0.15 g of Ag/m$^2$ |
| Gelatin | 1.8 g/m$^2$ |
| ExS-6 | 9 × 10$^{-4}$ mol/mol of AgX |
| ExC-1 | 0.06 g/m$^2$ |
| ExC-4 | 0.03 g/m$^2$ |
| ExY-9 | 0.14 g/m$^2$ |
| ExY-11 | 0.89 g/m$^2$ |
| Solv-1 | 0.42 g/m$^2$ |
| 13th Layer: Interlayer: | |
| Gelatin | 0.7 g/m$^2$ |
| ExY-12 | 0.20 g/m$^2$ |
| Solv-1 | 0.34 g/m$^2$ |
| 14th Layer: High Speed Blue-Sensitive Emulsion Layer: | |
| Silver Iodobromide Emulsion (AgI: 10 mol %; high internal AgI type; sphere equivalent diameter: 1.0 μm; coefficient of variation of sphere equivalent diameter: 25%; multiple twinned tabular grains; diameter/thickness ratio: 2.0) | 0.5 g of Ag/m$^2$ |
| Gelatin | 0.5 g/m$^2$ |
| ExS-6 | 1 × 10$^{-4}$ mol/mol of AgX |
| ExY-9 | 0.01 g/m$^2$ |
| ExY-11 | 0.20 g/m$^2$ |
| ExC-1 | 0.02 g/m$^2$ |
| Solv-1 | 0.10 g/m$^2$ |
| 15th Layer: 1st Protective Layer: | |
| Fine Silver Iodobromide Emulsion (AgI: 2 mol %; uniform AgI type; sphere equivalent diameter: 0.07 μm) | 0.12 g of Ag/m$^2$ |
| Gelatin | 0.9 g/m$^2$ |
| UV-4 | 0.11 g/m$^2$ |
| UV-5 | 0.16 g/m$^2$ |
| Solv-5 | 0.02 g/m$^2$ |
| H-1 | 0.13 g/m$^2$ |
| Polyethyl Acrylate Latex | 0.09 g/m$^2$ |
| 16th Layer: 2nd Protective Layer: | |
| Fine Silver Iodobromide Emulsion (AgI: 2 mol %; uniform AgI type; sphere equivalent diameter: 0.07 μm) | 0.36 g of Ag/m$^2$ |
| Gelatin | 0.55 g/m$^2$ |
| Polymethyl Methacrylate Particles (diameter: 1.5 μm) | 0.2 g/m$^2$ |

-continued

| | |
|---|---|
| H-1 | 0.1 g/m$^2$ |

UV: Ultraviolet absorbent
Solv: High boiling organic solvent
ExF: Dye
ExS: Sensitizing dye
ExC: Cyan coupler
ExM: Magenta coupler
ExY: Yellow coupler
Cpd: Additive
H: Hardening agent Each of the layers additionally contained 0.07 g/m$^2$ of Cpd-3 as an emulsion stabilizer and 0.03 g/m$^2$ of Cpd-4 as a surface active agent.

The compounds used in the sample preparation are as follows.

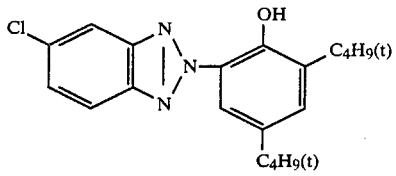

UV-1

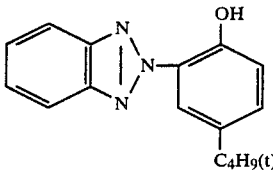

UV-2

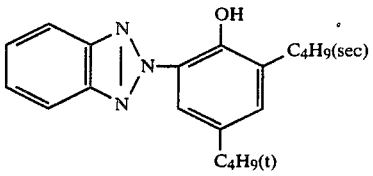

UV-3

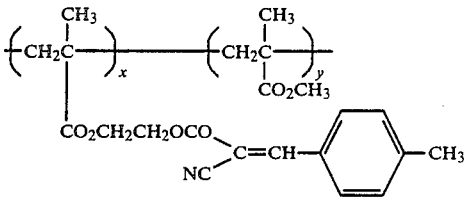

x/y = 70/30 (wt %)

UV-4

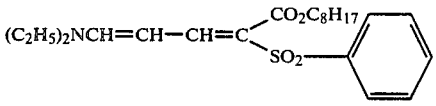

UV-5

Tricresyl Phosphate — Solv-1
Dibutyl Phthalate — Solv-2

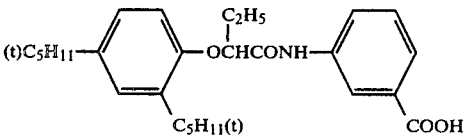

Solv-4

Trihexyl Phosphate — Solv-3

-continued
ExF-1
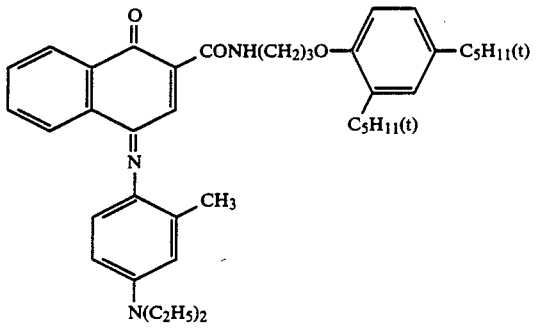
ExF-2
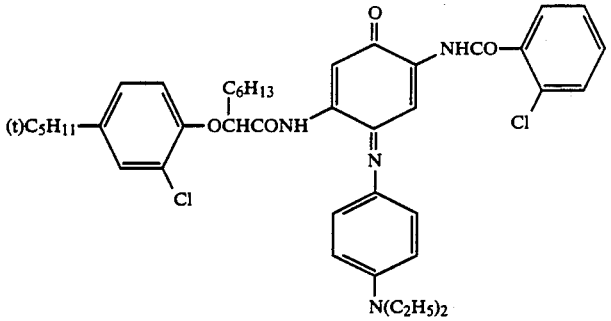
ExS-1
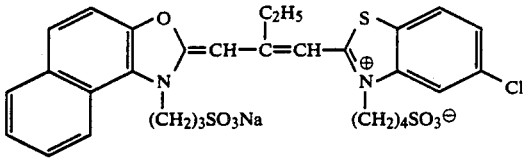
ExS-2
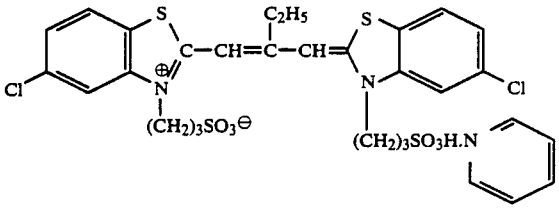
ExS-3
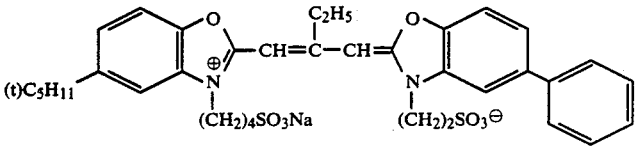
ExS-4
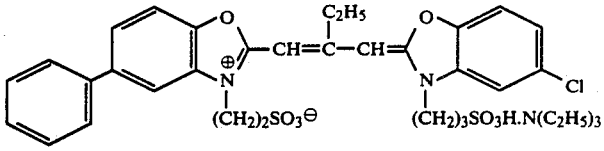
ExS-5
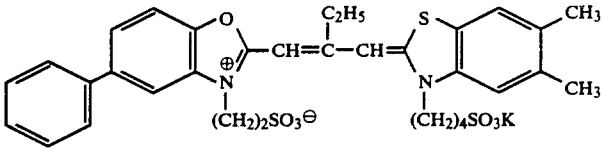

-continued
ExS-6
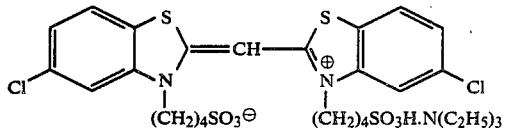
ExS-7
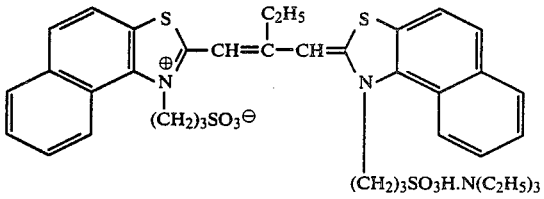
ExS-8
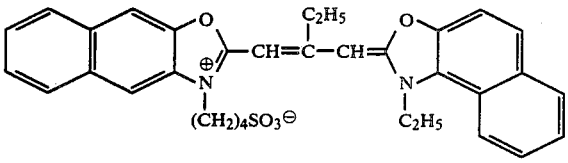
ExC-1
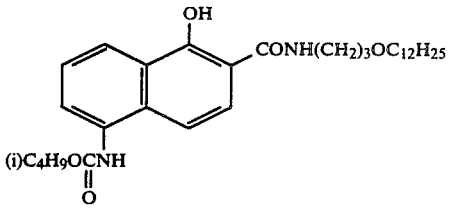
ExC-2
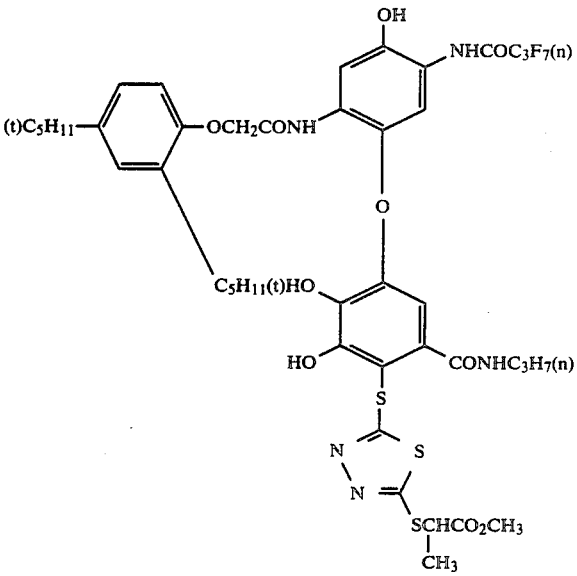

-continued
ExC-3
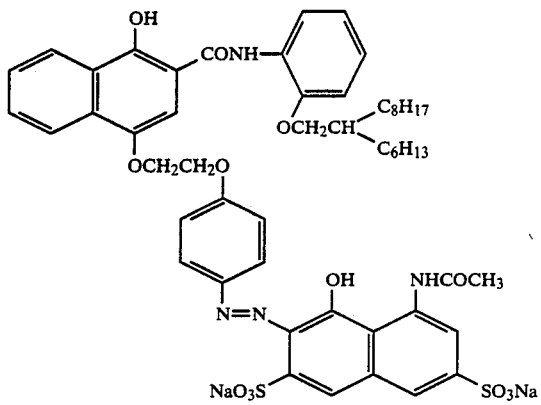
ExC-4
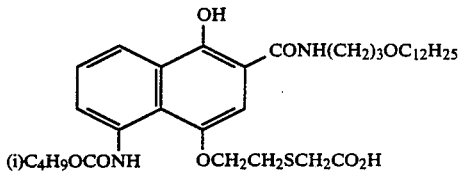
ExM-5
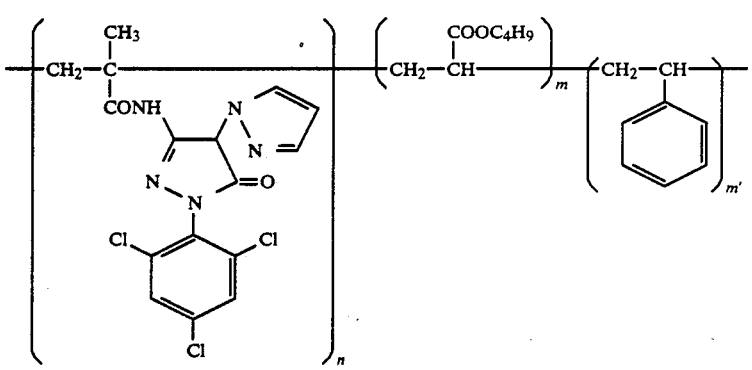
n = 50 mol %
m = 25 mol %
m' = 25 mol %
mol. wt. about 20,000
ExM-6
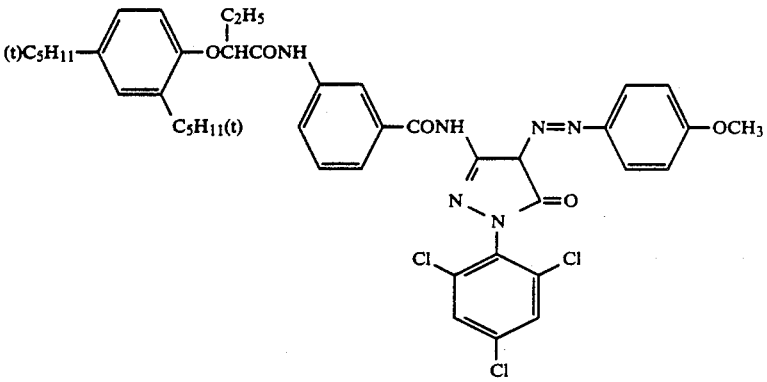

-continued
ExM-7
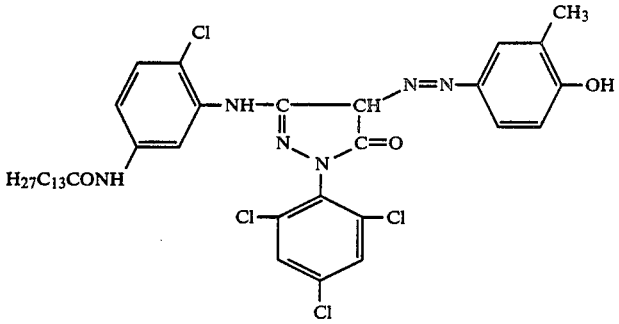
ExM-10
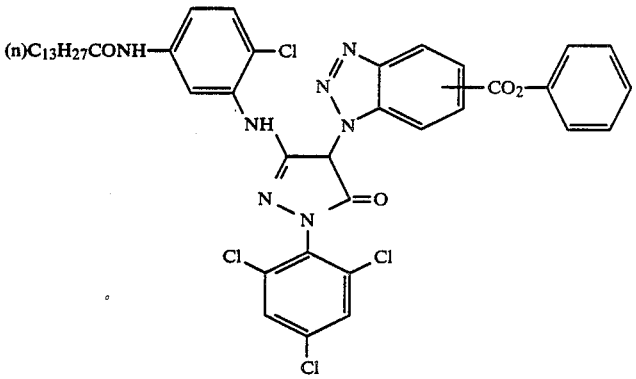
ExY-8
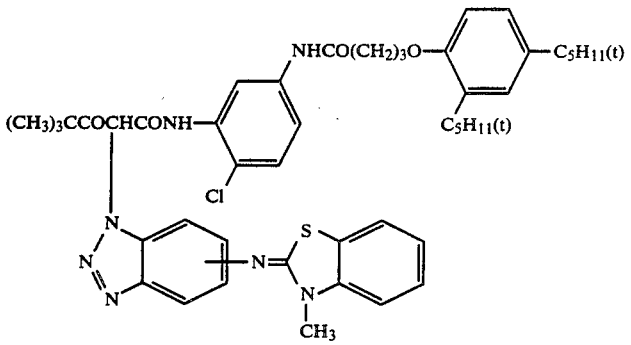
ExY-9
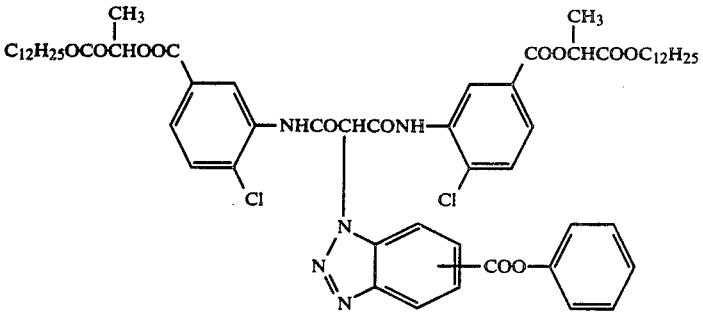

-continued
ExY-11
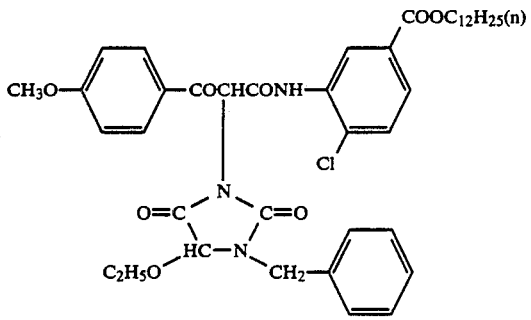
ExY-12
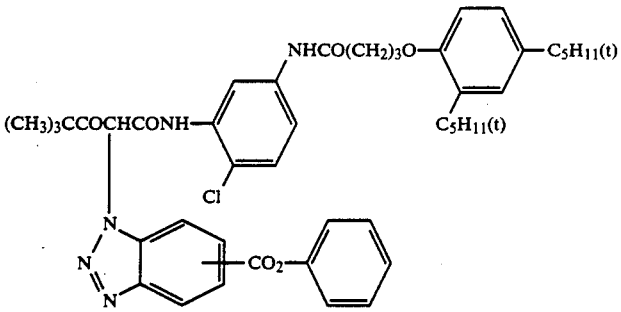
Cpd-7
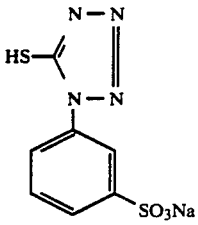
Cpd-1
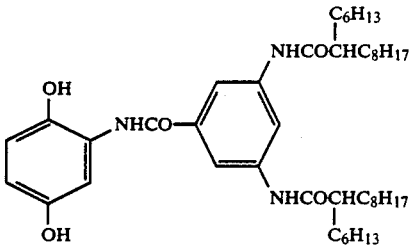
Cpd-2
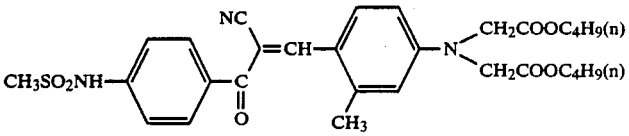
Cpd-6
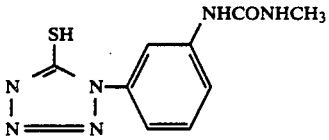
Cpd-5
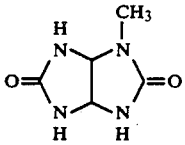

-continued

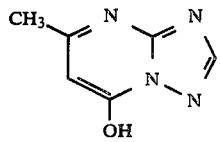

Cpd-3

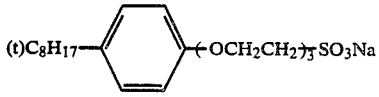

Cpd-4

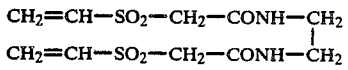

H-1

Sample 03 (a color light-sensitive material)

A triacetyl cellulose film support was coated with the following layers in the order listed to prepare a multilayer color light-sensitive material (Sample 03).

| | |
|---|---|
| **1st Layer: Antihalation Layer:** | |
| Black Colloidal Silver | 0.18 g/m$^2$ |
| Gelatin | 0.40 g/m$^2$ |
| **2nd Layer: Interlayer:** | |
| 2,5-Di-t-pentadecylhydroquinone | 0.18 g/m$^2$ |
| EX-1 | 0.07 g/m$^2$ |
| EX-3 | 0.02 g/m$^2$ |
| EX-12 | 0.002 g/m$^2$ |
| U-1 | 0.06 g/m$^2$ |
| U-2 | 0.08 g/m$^2$ |
| U-3 | 0.10 g/m$^2$ |
| HBS-1 | 0.10 g/m$^2$ |
| HBS-2 | 0.02 g/m$^2$ |
| Gelatin | 1.04 g/m$^2$ |
| **3rd Layer: 1st Red-Sensitive Emulsion Layer:** | |
| Emulsion A | 0.25 g of Ag/m$^2$ |
| Emulsion B | 0.25 g of Ag/m$^2$ |
| Sensitizing Dye I | $6.9 \times 10^{-5}$ mol/mol of AgX |
| Sensitizing Dye II | $1.8 \times 10^{-5}$ mol/mol of AgX |
| Sensitizing Dye III | $3.1 \times 10^{-4}$ mol/mol of AgX |
| EX-2 | 0.335 g/m$^2$ |
| EX-10 | 0.020 g/m$^2$ |
| Gelatin | 0.87 g/m$^2$ |
| **4th Layer: 2nd Red-Sensitive Emulsion Layer:** | |
| Emulsion C | 1.0 g of Ag/m$^2$ |
| Sensitizing Dye I | $5.1 \times 10^{-5}$ mol/mol of AgX |
| Sensitizing Dye II | $1.4 \times 10^{-5}$ mol/mol of AgX |
| Sensitizing Dye III | $2.3 \times 10^{-4}$ mol/mol of AgX |
| EX-2 | 0.400 g/m$^2$ |
| EX-3 | 0.050 g/m$^2$ |
| EX-10 | 0.015 g/m$^2$ |
| Gelatin | 1.30 g/m$^2$ |
| **5th Layer: 3rd Red-Sensitive Emulsion Layer:** | |
| Emulsion D | 1.60 g of Ag/m$^2$ |
| Sensitizing Dye I | $5.4 \times 10^{-5}$ mol/mol of AgX |
| Sensitizing Dye II | $1.4 \times 10^{-5}$ mol/mol of AgX |
| Sensitizing Dye III | $2.4 \times 10^{-4}$ mol/mol of AgX |
| EX-3 | 0.010 g/m$^2$ |
| EX-4 | 0.080 g/m$^2$ |
| EX-2 | 0.097 g/m$^2$ |
| HBS-1 | 0.22 g/m$^2$ |
| HBS-2 | 0.10 g/m$^2$ |
| Gelatin | 1.63 g/m$^2$ |
| **6th Layer: Interlayer:** | |
| EX-5 | 0.040 g/m$^2$ |
| HBS-1 | 0.020 g/m$^2$ |
| Gelatin | 0.80 g/m$^2$ |
| **7th Layer: 1st Green-Sensitive Emulsion Layer:** | |
| Emulsion A | 0.15 g of Ag/m$^2$ |
| Emulsion B | 0.15 g of Ag/m$^2$ |
| Sensitizing Dye V | $3.0 \times 10^{-5}$ mol/mol of AgX |
| Sensitizing Dye VI | $1.0 \times 10^{-4}$ mol/mol of AgX |
| Sensitizing Dye VII | $3.8 \times 10^{-4}$ mol/mol of AgX |
| EX-6 | 0.260 g/m$^2$ |
| EX-1 | 0.021 g/m$^2$ |

-continued

| | |
|---|---|
| EX-7 | 0.030 g/m$^2$ |
| EX-8 | 0.025 g/m$^2$ |
| HBS-1 | 0.100 g/m$^2$ |
| HBS-3 | 0.010 g/m$^2$ |
| Gelatin | 0.63 g/m$^2$ |
| **8th Layer: 2nd Green-Sensitive Emulsion Layer:** | |
| Emulsion C | 0.45 g of Ag/m$^2$ |
| Sensitizing Dye V | $2.1 \times 10^{-5}$ mol/mol of AgX |
| Sensitizing Dye VI | $7.0 \times 10^{-5}$ mol/mol of AgX |
| Sensitizing Dye VII | $2.6 \times 10^{-4}$ mol/mol of AgX |
| EX-6 | 0.094 g/m$^2$ |
| EX-8 | 0.018 g/m$^2$ |
| EX-7 | 0.026 g/m$^2$ |
| HBS-1 | 0.160 g/m$^2$ |
| HBS-3 | 0.008 g/m$^2$ |
| Gelatin | 0.50 g/m$^2$ |
| **9th Layer: 3rd Green-Sensitive Emulsion Layer:** | |
| Emulsion E | 1.2 g of Ag/m$^2$ |
| Sensitizing Dye V | $3.5 \times 10^{-5}$ mol/mol of AgX |
| Sensitizing Dye VI | $8.0 \times 10^{-5}$ mol/mol of AgX |
| Sensitizing Dye VII | $3.0 \times 10^{-4}$ mol/mol of AgX |
| EX-13 | 0.015 g/m$^2$ |
| EX-11 | 0.100 g/m$^2$ |
| EX-1 | 0.025 g/m$^2$ |
| HBS-1 | 0.25 g/m$^2$ |
| HBS-2 | 0.10 g/m$^2$ |
| Gelatin | 1.54 g/m$^2$ |
| **10th Layer: Yellow Filter Layer:** | |
| Yellow Colloidal Silver | 0.05 g/m$^2$ |
| EX-5 | 0.08 g/m$^2$ |
| HBS-1 | 0.03 g/m$^2$ |
| Gelatin | 0.95 g/m$^2$ |
| **11th Layer: 1st Blue-Sensitive Emulsion Layer:** | |
| Emulsion A | 0.08 g of Ag/m$^2$ |
| Emulsion B | 0.07 g of Ag/m$^2$ |
| Emulsion F | 0.07 g of Ag/m$^2$ |
| Sensitizing Dye VIII | $3.5 \times 10^{-4}$ mol/mol of AgX |
| EX-9 | 0.721 g/m$^2$ |
| EX-8 | 0.042 g/m$^2$ |
| HBS-1 | 0.28 g/m$^2$ |
| Gelatin | 1.10 g/m$^2$ |
| **12th Layer: 2nd Blue-Sensitive Emulsion Layer:** | |
| Emulsion G | 0.45 g of Ag/m$^2$ |
| Sensitizing Dye VIII | $2.1 \times 10^{-4}$ mol/mol of AgX |
| EX-9 | 0.154 g/m$^2$ |
| EX-10 | 0.007 g/m$^2$ |
| HBS-1 | 0.05 g/m$^2$ |
| Gelatin | 0.78 g/m$^2$ |
| **13th Layer: 3rd Blue-Sensitive Emulsion Layer:** | |
| Emulsion H | 0.77 g of Ag/m$^2$ |
| Sensitizing Dye VIII | $2.2 \times 10^{-4}$ mol/mol of AgX |
| EX-9 | 0.20 g/m$^2$ |
| HBS-1 | 0.07 g/m$^2$ |
| Gelatin | 0.69 g/m$^2$ |
| **14th Layer: 1st Protective Layer:** | |
| Emulsion I | 0.5 g of Ag/m$^2$ |
| U-4 | 0.11 g/m$^2$ |
| U-5 | 0.17 g/m$^2$ |
| HBS-1 | 0.05 g/m$^2$ |
| Gelatin | 1.00 g/m$^2$ |

-continued

| 15th Layer: 2nd Protective Layer: | |
|---|---|
| Polymethyl Acrylate Particles (diameter: about 1.5 μm) | 0.54 g/m$^2$ |
| S-1 | 0.20 g/m$^2$ |

-continued

| | |
|---|---|
| Gelatin | 1.20 g/m$^2$ |

Each of the layers further contained Gelatin Hardener H-1 and a surface active agent.

The emulsions and compounds used in the sample preparation are shown below.

| Emulsion | Average AgI Content (%) | Mean Grain Size (μm) | Coefficient of Variation of Grain Size (%) | Diameter/ Thickness Ratio | Ag Content Ratio (AgI Content: mol %) |
|---|---|---|---|---|---|
| A | 4.3 | 0.45 | 27 | 1 | core/middle/shell = 8/16/76 (0/27/0), triple layer structure |
| B | 8.7 | 0.70 | 14 | 1 | core/middle/shell = 8/16/76 (0/27/0), triple layer structure |
| C | 10 | 0.75 | 30 | 2 | core/shell = 1/2 (24/3), double layer structure |
| D | 16 | 1.05 | 35 | 2 | core/shell = 1/2 (40/0), double layer structure |
| E | 10 | 1.05 | 35 | 3 | core/shell = 1/2 (24/3), double layer structure |
| F | 4.3 | 0.25 | 28 | 1 | core/middle/shell = 8/16/76 (0/27/0), triple layer structure |
| G | 14 | 0.75 | 25 | 2 | core/shell = 1/2 (40/0), double layer structure |
| H | 14 | 1.30 | 25 | 3 | core/shell = 1/2 (40/0), double layer structure |
| I | 1 | 0.07 | 15 | 1 | core/shell = 1/2 (24/3), double layer structure |

EX-1

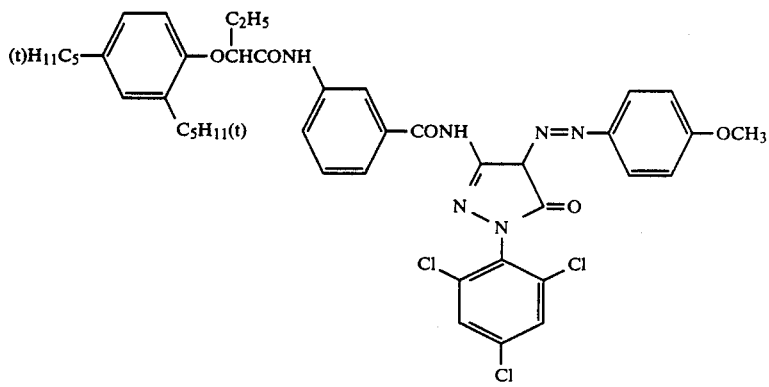

EX-2

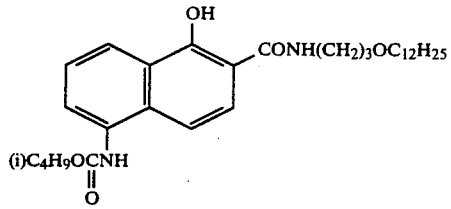

EX-3

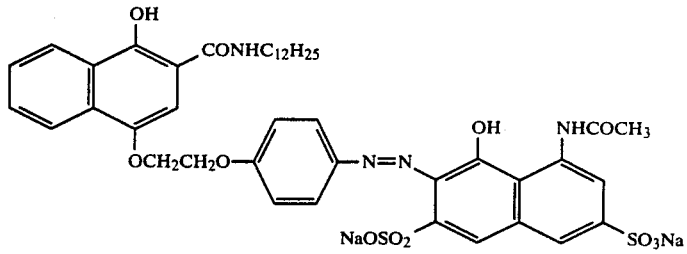

-continued
EX-4
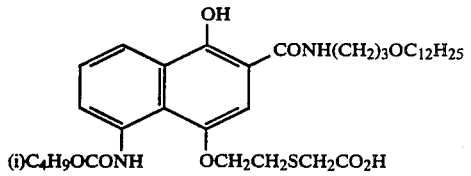
EX-5
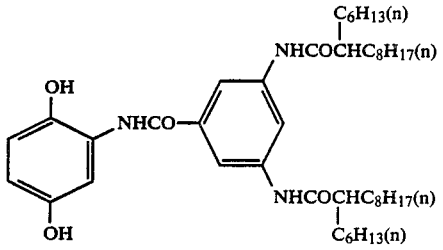
EX-6
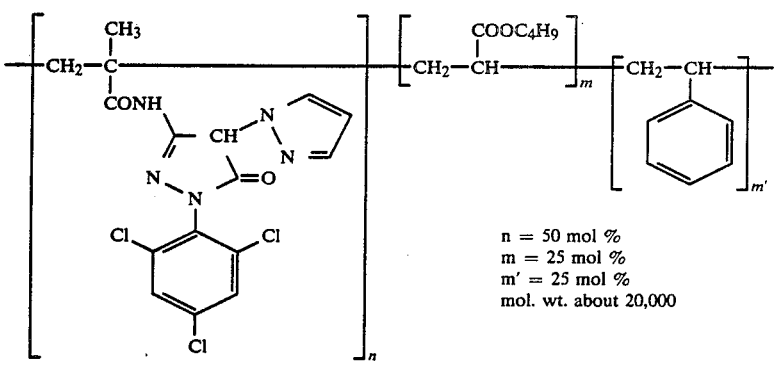
n = 50 mol %
m = 25 mol %
m' = 25 mol %
mol. wt. about 20,000
EX-7
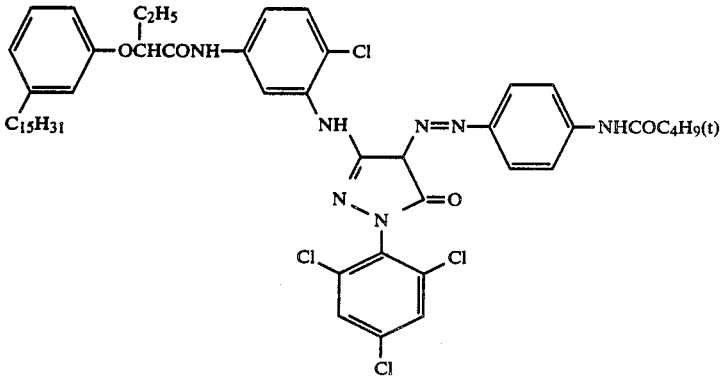
EX-8
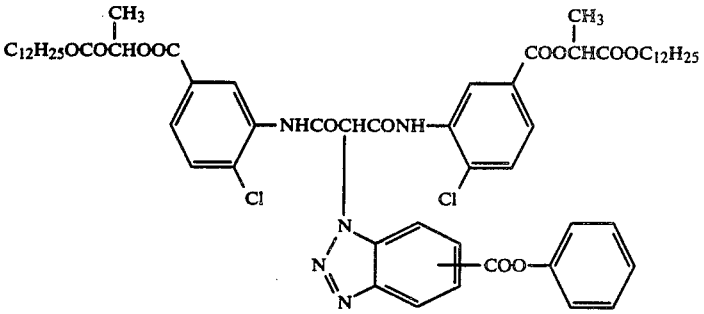

-continued
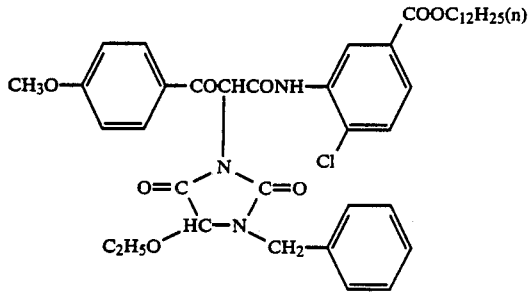
EX-9
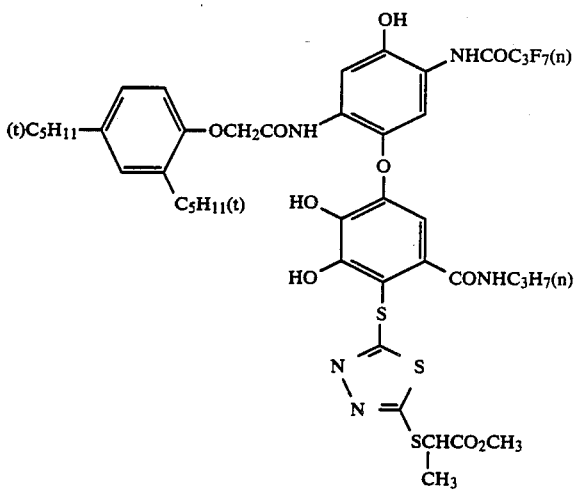
EX-10
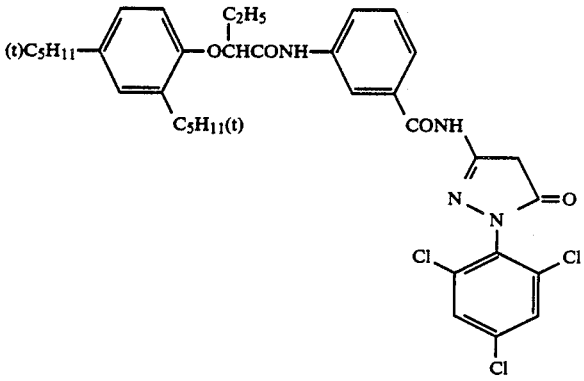
EX-11
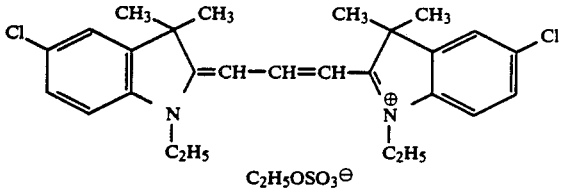
EX-12

-continued
EX-13
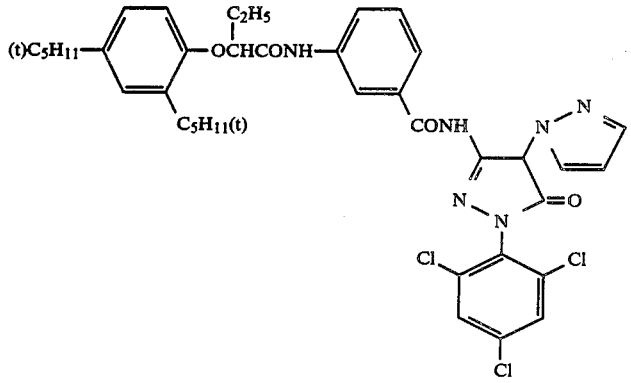
U-1
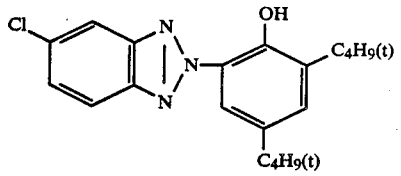
U-2
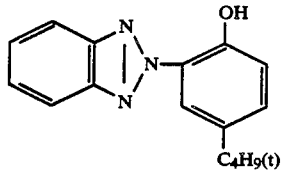
U-3
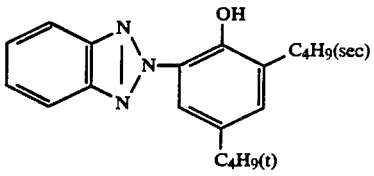
U-4
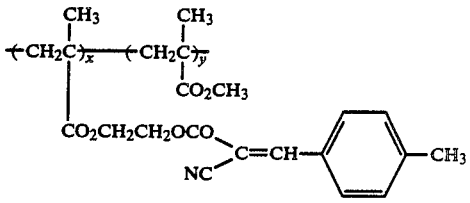
x/y = 70/30 (wt %)
UV-5
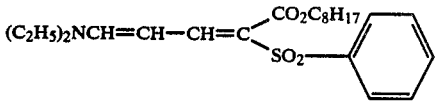
Tricresyl Phosphate HBS-1
Di-n-butyl Phthalate HBS-2
HBS-3
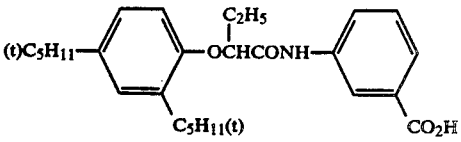

-continued

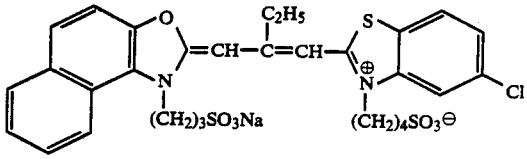

Sensitizing Dye I

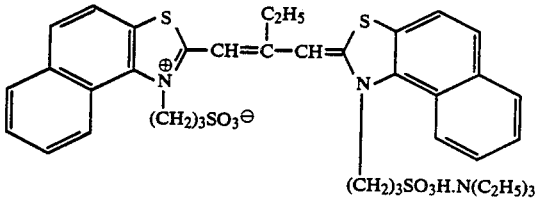

Sensitizing Dye II

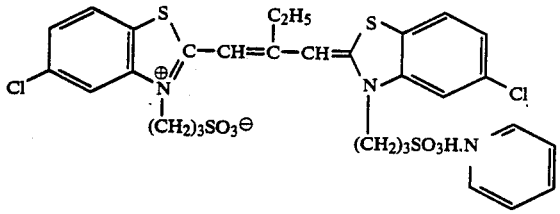

Sensitizing Dye III

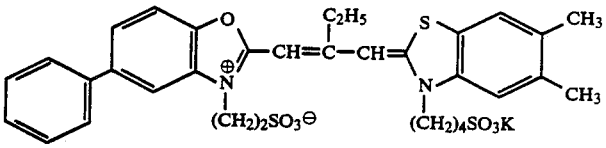

Sensitizing Dye V

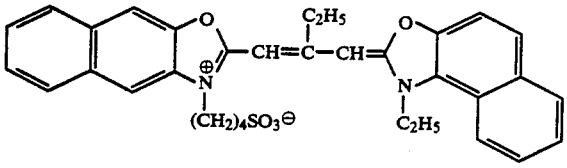

Sensitizing Dye VI

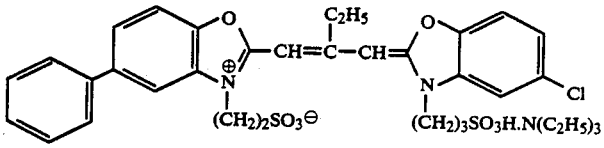

Sensitizing Dye VII

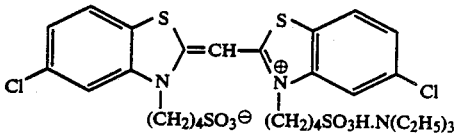

Sensitizing Dye VIII

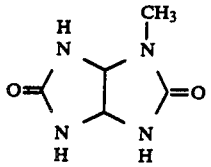

S-1

$CH_2{=}CH{-}SO_2{-}CH_2{-}CONH{-}CH_2$
$CH_2{=}CH{-}SO_2{-}CH_2{-}CONH{-}CH_2$

H-1

EXAMPLE 4

The same procedure as in Example 2 was carried out except that the processing step and the processing solution were changed as follows.

It was confirmed that the same desilvering as in Example 2 was sufficiently achieved according to the present invention.

TABLE 3

| Processing Step | Processing Temperature (°C.) | Processing Step Time | Replenisher Amount (ml/35 mm (w) × 1 m) | Tank Capacity (l) |
|---|---|---|---|---|
| Color Development | 37.8 | 3 min 15 sec | 21 | 5 |
| Bleaching | 38.0 | 45 sec | 4.5 | 2 |
| Fixing (1) | 38.0 | 45 sec | (two-tank countercurrent system) 30 | 2 |
| Fixing (2) | 38.0 | 45 sec | | 2 |
| Stabilization (1) | 38.0 | 20 sec | (three-tank countercurrent system) 35 | 1 |
| Stabilization (2) | 38.0 | 20 sec | | 1 |
| Stabilization (3) | 38.0 | 20 sec | | 1 |
| Drying | 55 | 1 min 00 sec | | |

The fixing tank of the automatic developing machine used was equipped with the jet stirring device illustrated in JP-A-62-183460 (page 3) so that the light-sensitive material was processed while being struck by a jet stream of the fixing solution.

In Example 4, the same developing solution and bleaching solution as in Example 2 were used. The composition of the fixing solution and stabilizing solution is shown below.

| Fixing Solution: | Mother Liquor | Replenisher |
|---|---|---|
| 1-Hydroxyethylidene-1,1-diphosphonic Acid | 5.0 g | 7.0 g |
| Disodium Ethylenediamine-tetraacetate | 0.5 g | 0.7 g |
| Sodium Sulfite | 10.0 g | 12.0 g |
| Sodium Bisulfite | 8.0 g | 10.0 g |
| Ammonium Thiosulfate Aqueous Solution (700 g/liter) | 170.0 ml | 200.0 ml |
| Ammonium Thiocyanate | 100.0 g | 150.0 g |
| Thiourea | 3.0 g | 5.0 g |
| 3,6-Dithia-1,8-octanediol | 3.0 g | 5.0 g |
| Water to make | 1.0 liter | 1.0 liter |
| Acetic Acid and Ammonia to adjust to a pH of | 6.5 | 6.7 |

| Stabilizinq Solution: (common to mother liquor and replenisher) | |
|---|---|
| Formalin (37 wt %) | 1.2 ml |
| 5-Chloro-2-methyl-4-isothiazolin-3-one | 6.0 mg |
| 2-Methyl-4-isothiazolin-3-one | 3.0 mg |
| Surface Active Agent of Formula: $C_{10}H_{21}—O(CH_2CH_2O)_{10}H$ | 0.4 g |
| Ethylene Glycol | 1.0 g |
| Water to make | 1.0 liter |
| pH | 5.0 to 7.0 |

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising the steps of:
   (a) developing an imagewise exposed silver halide color photographic material containing at least one color coupler with a color developing solution comprising not less than $1.9\times10^{-2}$ mol/liter of a color developing agent; and
   (b) desilvering said developed material with a bleaching solution comprising not less than 0.2 mol/liter of a (1,3-diaminopropanetetraacetato)iron (III) complex salt and having a pH of from 2.5 to 5.5.

2. The method as claimed in claim 1, wherein the color developing solution contains from $1.9\times10^{-2}$ to $1.0\times10^{-1}$ mol/liter of a color developing agent.

3. The method as claimed in claim 1, wherein the color developing solution contains from $2.4\times10^{-2}$ to $1.0\times10^{-1}$ mol/liter of a color developing agent.

4. The method as claimed in claim 1, wherein the bleaching solution contains from 0.25 to 0.5 mol/ liter of a (1,3-diaminopropanetetraacetato)iron (III) complex salt.

5. The method as claimed in claim 1, wherein the bleaching solution contains from 0.3 to 0.5 mol/liter of a (1,3-diaminopropanetetraacetato)iron (III) complex salt.

6. The method as claimed in claim 1, wherein the (1,3-diaminopropanetetraacetato)iron (III) complex salt is ammonium (1,3-diaminopropanetetraacetato)iron (III) complex salt.

7. The method as claimed in claim 1, wherein the bleaching solution has a pH of from 2.5 to 4.5.

8. The method as claimed in claim 1, wherein the bleaching solution has a pH of from 2.5 to 4.0.

9. The method as claimed in claim 1, wherein the color developing agent is a p-phenylenediamine derivative or a salt thereof.

10. The method as claimed in claim 9, wherein the p-phenylenediamine derivative is 2-methyl-4-[N-ethyl-N-(β-hydroxyethyl)amino]aniline or a sulfate of 2-methyl-4-[N-ethyl-N-(β-hydroxyethyl)amino]aniline.

11. The method as claimed in claim 1, wherein said silver halide color photographic material comprises silver bromoiodide or silver chlorobromoiodide having a silver iodide content of from about 2 mol% to about 25 mol%.

12. The method as claimed in claim 1, wherein said method comprises developing said silver halide color photographic material for from 30 seconds 3 minutes.

13. The method as claimed in claim 1, wherein said desilvering further comprises fixing said bleached material, and said desilvering is conducted for from 1 to 4 minutes.

14. The method as claimed in claim 13, wherein said desilvering is conducted for from 1 minute and 30 seconds to 3 minutes.

* * * * *